US009249556B2

(12) United States Patent
Magaki et al.

(10) Patent No.: US 9,249,556 B2
(45) Date of Patent: Feb. 2, 2016

(54) SHOVEL AND METHOD FOR CONTROLLING SHOVEL

(75) Inventors: Hideto Magaki, Chiba (JP); Ryuji Shiratani, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/003,302

(22) PCT Filed: Mar. 6, 2012

(86) PCT No.: PCT/JP2012/055702

§ 371 (c)(1),
(2), (4) Date: Sep. 5, 2013

(87) PCT Pub. No.: WO2012/121252

PCT Pub. Date: Sep. 13, 2012

(65) Prior Publication Data

US 2013/0345939 A1 Dec. 26, 2013

(30) Foreign Application Priority Data

Mar. 8, 2011 (JP) ..... 2011-050790
Mar. 24, 2011 (JP) ..... 2011-066732
Apr. 22, 2011 (JP) ..... 2011-096414

(51) Int. Cl.
*E02F 9/00* (2006.01)
*E02F 9/22* (2006.01)
(Continued)

(52) U.S. Cl.
CPC ..... *E02F 9/2203* (2013.01); *E02F 3/435* (2013.01); *E02F 9/2033* (2013.01); *E02F 9/2075* (2013.01); *E02F 9/2214* (2013.01); *E02F 9/2235* (2013.01); *E02F 9/2246* (2013.01); *E02F 9/2282* (2013.01);
(Continued)

(58) Field of Classification Search
None
See application file for complete search history.

(56) References Cited

U.S. PATENT DOCUMENTS 4,896,582 A 1/1990 Tordenmalm et al.
6,047,228 A 4/2000 Stone et al.
(Continued)

FOREIGN PATENT DOCUMENTS

EP 0915208 A1 5/1999
JP 04-070427 3/1992
(Continued)

OTHER PUBLICATIONS
International Search Report mailed on Jun. 12, 2012.

*Primary Examiner* — John R Olszewski
*Assistant Examiner* — James M McPherson
(74) *Attorney, Agent, or Firm* — IPUSA, PLLC

(57) ABSTRACT

An hydraulic shovel according to the present invention includes a lower running body 1, an upper turning body 3 turnably mounted on the lower running body 1, a boom 4 pivotably attached to the upper turning body 3, an arm 5 pivotably attached to the boom 4, a bucket 6 attached to the arm 5, an boom angle sensor S1 which detects a condition of the boom 4, an attachment condition determining part 300 which determines whether the boom 4 is within a predetermined upper working range based on a detection value of the boom angle sensor S1, and an operating condition switching part 301 which switches an operating condition of the hydraulic shovel. The operating condition switching part 301 slows down a movement of the bucket 6 if the attachment condition determining part 300 determines that an attachment is within the predetermined upper working range UWR.

19 Claims, 25 Drawing Sheets

(51) Int. Cl.
*E02F 9/20* (2006.01)
*E02F 3/43* (2006.01)
*E02F 9/26* (2006.01)

(52) U.S. Cl.
CPC ..... *E02F 9/2285* (2013.01); *E02F 9/2292* (2013.01); *E02F 9/2296* (2013.01); *E02F 9/265* (2013.01)

(56) References Cited

U.S. PATENT DOCUMENTS

| | | | | |
|---|---|---|---|---|
| 6,098,322 | A * | 8/2000 | Tozawa et al. | 37/414 |
| 6,257,118 | B1 | 7/2001 | Wilbur et al. | |
| 6,275,757 | B1 * | 8/2001 | Watanabe et al. | 701/50 |
| 7,610,136 | B2 * | 10/2009 | Okamura et al. | 701/50 |
| 2004/0098984 | A1 | 5/2004 | Duell et al. | |
| 2008/0142232 | A1 | 6/2008 | Palmer et al. | |
| 2010/0089050 | A1 * | 4/2010 | Filla | 60/433 |
| 2010/0107996 | A1 * | 5/2010 | Shintani et al. | 123/41.11 |
| 2011/0150615 | A1 * | 6/2011 | Ishii | 414/687 |
| 2011/0318157 | A1 * | 12/2011 | Okamura et al. | 414/687 |
| 2012/0057956 | A1 * | 3/2012 | Shirao et al. | 414/707 |
| 2012/0082536 | A1 | 4/2012 | Kawashima et al. | |
| 2012/0089288 | A1 | 4/2012 | Kawashima | |

FOREIGN PATENT DOCUMENTS

| | | | |
|---|---|---|---|
| JP | 2002-004339 | | 1/2002 |
| JP | 2004-100814 | | 4/2004 |
| JP | 2009-155901 | | 7/2009 |
| WO | WO 2009/087795 | * | 7/2009 |
| WO | WO2010131654 | * | 11/2010 |
| WO | WO 2010/143628 | | 12/2010 |
| WO | WO 2010/147121 | | 12/2010 |

* cited by examiner

SHOVEL AND METHOD FOR CONTROLLING SHOVEL

TECHNICAL FIELD

The present invention relates to a shovel including an attachment including a boom, an arm, and an end attachment, and to a method for controlling the shovel. In particular, the present invention relates to a shovel which improves energy efficiency in a case where a rapid movement of the end attachment is not required, and to a method for controlling the shovel.

BACKGROUND ART

A hydraulic shovel which facilitates a movement of a boom by supplying enough hydraulic oil required for lifting the boom and improves a workability in a case of simultaneously performing a bucket closing, an arm closing, and a boom lifting, is known (see e.g., PATENT DOCUMENT 1).

This hydraulic shovel increases an amount of a hydraulic oil flowing into a direction control valve for the boom while preventing an excessive hydraulic oil from flowing into a direction control valve for the arm in a case where pilot valves for the bucket, the arm, and the boom have been operated simultaneously.

Thus, this hydraulic shovel facilitates the movement of the boom in the case of simultaneously performing the bucket closing, the arm closing, and the boom lifting, without unduly slowing down a movement pace of the bucket.

RELATED ART DOCUMENT

Patent Document

Patent Document 1: Japanese Unexamined Patent Publication No. 2002-4339

DISCLOSURE OF THE INVENTION

Problem to be Solved by the Invention

However, PATENT DOCUMENT 1 refers only to a control for preventing a significant slow down of the movement pace of the boom in the case of simultaneously performing a bucket closing, an arm closing, and a boom lifting. It never mentions a control in a case of performing work in which a fast operation of the bucket is not required.

In view of the above, it is an objective of the present invention to provide a shovel which improves energy efficiency in a case where a rapid movement of the end attachment is not required, and a method for controlling the shovel.

Means for Solving the Problem

To achieve the above objective, the shovel according to an embodiment of the present invention includes a lower running body, an upper turning body turnably mounted on the lower running body, and a front working machine including a boom, an arm, and an end attachment. The shovel also includes a front working machine condition detecting part configured to detect a condition of the front working machine, an attachment condition determining part configured to determine whether the boom is within a predetermined upper working range based on a detection value of the front working machine condition detecting part, and an operating condition switching part configured to switch an operating condition of the shovel. The operating condition switching part slows a movement of the end attachment if the attachment condition determining part determines that the end attachment is within the predetermined upper working range.

Also, a method for controlling a shovel according to an embodiment of the present invention is a method for controlling a shovel including a lower running body, an upper turning body turnably mounted on the lower running body, and a front working machine including a boom, an arm, and an end attachment. The method includes a front working machine condition detecting step of detecting a condition of the front working machine, an attachment condition determining step of determining whether the boom is in a predetermined upper working range based on a detection value detected in the front working machine condition detecting step, and an operating condition switching step of switching an operating condition of the shovel. In the operating condition switching step, a movement of the end attachment slows down if it is determined that the end attachment is within the predetermined upper working range in the attachment condition determining step.

Effects of the Invention

According to the above means, the present invention can provide a shovel which improves energy efficiency in a case where a rapid movement of the end attachment is not required, and a method for controlling the shovel.

MODE FOR CARRYING OUT THE INVENTION

In what follows, preferred embodiments of the present invention are described with reference to the accompanying drawings.

First Embodiment

Figure 1:
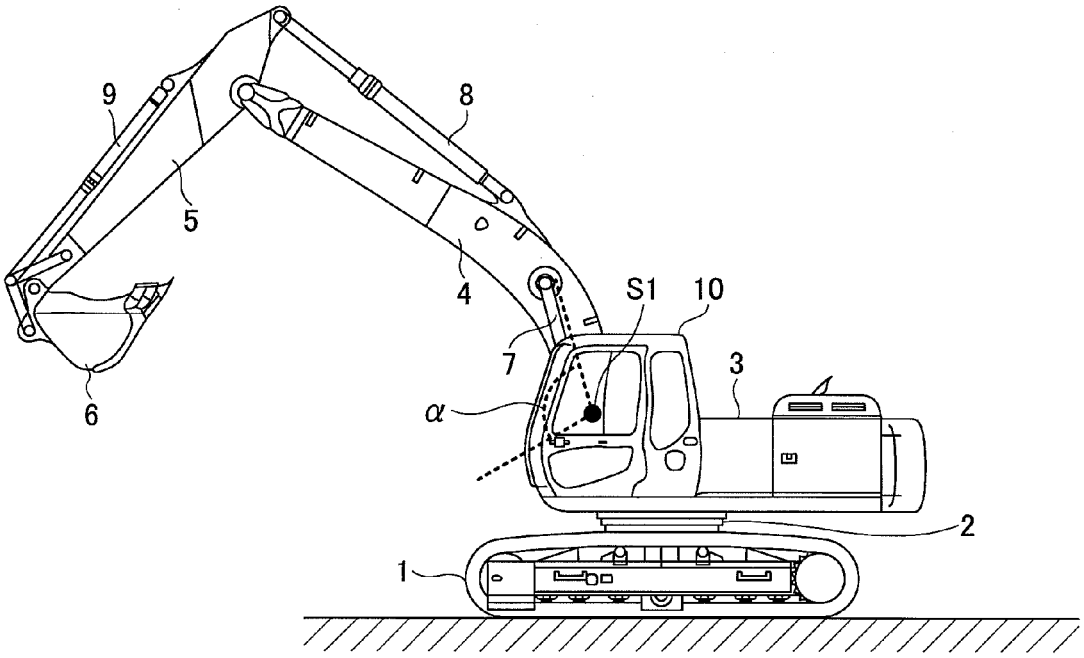
FIG. 1 is a diagram showing a configuration example of a hydraulic shovel according to an embodiment of the present invention.

FIG. 1 is a side view of a hydraulic shovel according to a first embodiment of the present invention.

An upper turning body 3 is mounted, via a turning mechanism 2, on a crawler-type lower running body 1 of the hydraulic shovel.

A boom 4 as a front working machine is attached to the upper turning body 3. An arm 5 as a front working machine is attached to a leading end of the boom 4. A bucket 6 as a front working machine and as an end attachment is attached to a leading end of the arm 5. The boom 4, the arm 5, and the bucket 6 constitute an attachment. Also, the boom 4, the arm 5, and the bucket 6 are hydraulically driven by a boom cylinder 7, an arm cylinder 8, and a bucket cylinder 9, respectively. A cabin 10 is arranged in the upper turning body 3, and a power source such as an engine is mounted to the upper turning body 3. In FIG. 1, the bucket 6 is shown as the end attachment. However, the bucket 6 may be replaced by a lifting magnet, a breaker, a fork, or the like.

The boom 4 is supported by the upper turning body 3 at a pivotally supporting part (at a joint) so that it can be lifted and lowered in relation to the upper turning body 3. A boom angle sensor S1 (see FIG. 2) as a front-working-machine-condition detecting part (a boom operating condition detecting part) is attached to the pivotally supporting part. A boom angle $\alpha$, which is an inclination angle of the boom 4 and a climb angle from a most lowered state of the boom 4, can be detected by the boom angle sensor S1.

Figure 2:
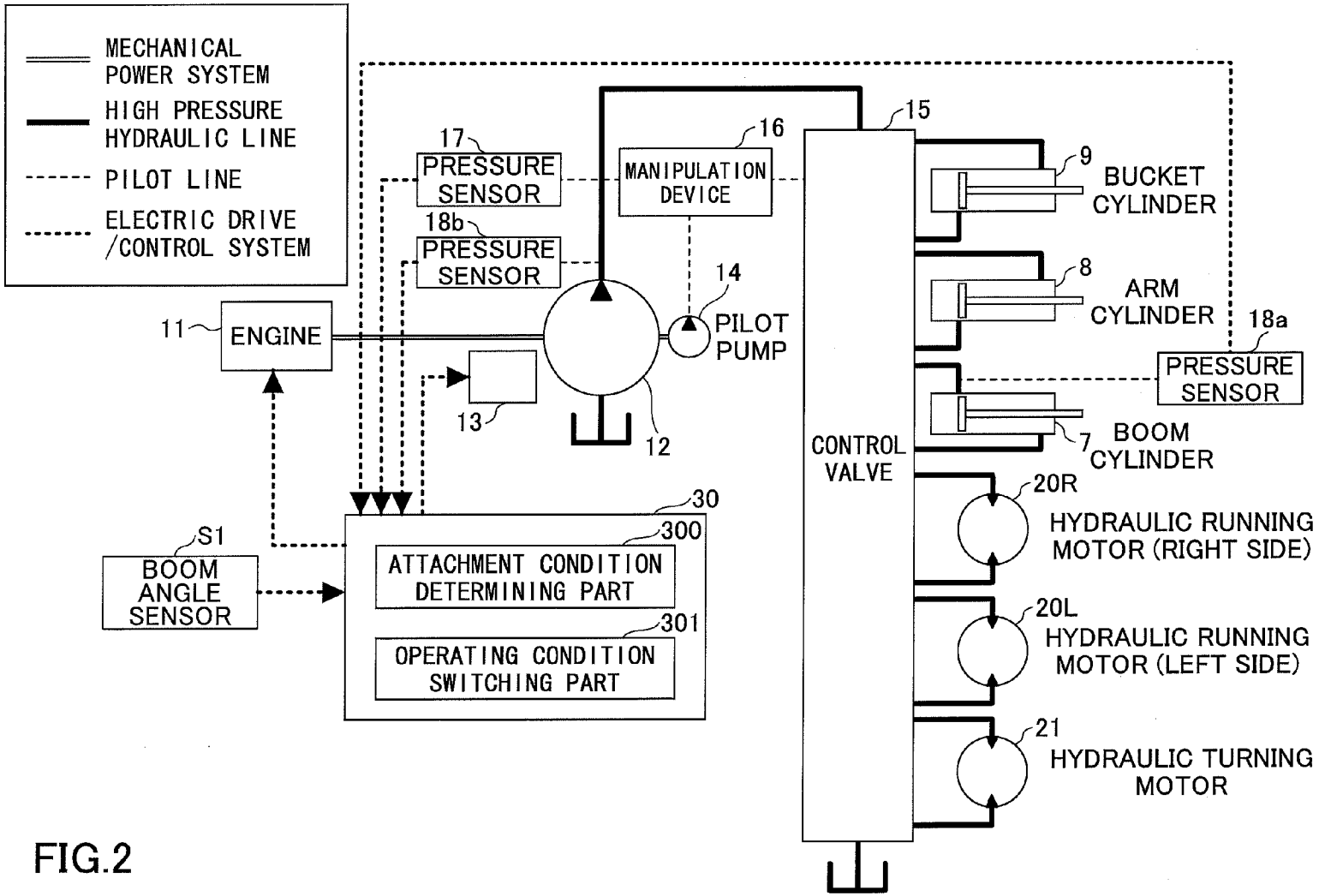
FIG. 2 is a first block diagram showing a configuration example of a drive system of the hydraulic shovel.

FIG. 2 is a block diagram showing a configuration example of a drive system of a hydraulic shovel. In FIG. 2, a mechanical power system, a high pressure hydraulic line, a pilot line, and an electric drive/control system are indicated by a double line, a solid line, a dashed line, and a dotted line, respectively.

The drive system of the hydraulic shovel mainly includes an engine 11, a main pump 12, a regulator 13, a pilot pump 14, a control valve 15, an manipulation device 16, a pressure sensor 17, and a controller 30.

The engine 11 is a drive source of the hydraulic shovel, for example, an engine which operates to maintain a predetermined rotational speed. An output shaft of the engine 11 is coupled to input shafts of the main pump 12 and the pilot pump 14.

The main pump 12 is a device configured to supply a hydraulic oil to the control valve 15 via a high pressure hydraulic line. For example, the main pump 12 is a variable displacement swash plate type hydraulic pump.

The regulator 13 is a device configured to regulate a discharge rate of the main pump 12. For example, the regulator 13 regulates a discharge rate of the main pump 12 by adjusting a swash plate tilt angle of the main pump 12 depending on a discharge pressure of the main pump 12, a control signal from the controller 30, or the like.

The pilot pump 14 is a device configured to supply a hydraulic oil to various hydraulic control instruments via pilot lines. For example, the pilot pump 14 is a fixed displacement type hydraulic pump.

The control valve 15 is a hydraulic control device configured to control a hydraulic system in the hydraulic shovel. For example, the control valve 15 supplies a hydraulic oil received from the main pump 12 to one or more of the boom cylinder 7, the arm cylinder 8, the bucket cylinder 9, a hydraulic running motor 20L (for a left side), a hydraulic running motor 20R (for a right side), and a hydraulic turning motor 21, selectively. In what follows, the boom cylinder 7, the arm cylinder 8, the bucket cylinder 9, the hydraulic running motor 20L (for the left side), the hydraulic running motor 20R (for the right side), and the hydraulic turning motor 21 are collectively referred to as "hydraulic actuators".

The manipulation device 16 is a device used by an operator to operate the hydraulic actuators. The manipulation device 16 supplies a hydraulic oil received from the pilot pump 14 to a pilot port of a flow control valve corresponding to each of the hydraulic actuators via a pilot line. A pressure (a pilot pressure) of the hydraulic oil supplied to each of the pilot ports corresponds to a direction and an amount of manipulation of a lever or a pedal (not shown) of the manipulation device 16 corresponding to each of the hydraulic actuators.

The pressure sensor 17 is a sensor configured to detect a manipulation content of the manipulation device 16 by an operator. For example, the pressure sensor 17 detects a direction and an amount of manipulation of a lever or a pedal of the manipulation device 16 corresponding to each of the hydraulic actuators in a form of a pressure. Then, the pressure sensor 17 outputs a detection value to the controller 30. The manipulation content of the manipulation device 16 may be detected by a sensor other than the pressure sensor.

The boom cylinder pressure sensor 18*a* detects a pressure in a bottom-side chamber of the boom cylinder 7, and outputs a detection value to the controller 30.

The discharge pressure sensor 18*b* detects a discharge pressure of the main pump 12, and outputs a detection value to the controller 30.

The controller 30 is a control device configured to control movement paces of the hydraulic actuators. For example, the controller 30 is a computer including a Central Processing Unit (CPU), a Random Access Memory (RAM), a Read Only Memory (ROM), and the like. Also, the controller 30 reads out a program corresponding to each of an attachment condition determining part 300 and an operating condition switching part 301 from the ROM, loads the program onto the RAM, and causes the CPU to perform a process corresponding to each program.

Specifically, the controller 30 receives detection values of the boom angle sensor S1, the pressure sensor 17, and the like. Then, the controller 30 performs a process by each of the attachment condition determining part 300 and the operating condition switching part 301 based on the detection values. Then, the controller 30 appropriately outputs to the regulator 13 a control signal corresponding to each of processing results of the attachment condition determining part 300 and the operating condition switching part 301.

The attachment condition determining part 300 is a functional element configured to determine whether an attachment is within a predetermined working range by detecting a condition of the attachment in order to obtain a position of the bucket 6. Specifically, the attachment condition determining part 300 calculates a climb angle of the boom 4 based on a detection value of the boom angle sensor S1. Then, the attachment condition determining part 300 can determine whether the attachment is within the predetermined working range if the attachment condition determining part 300 determines that the boom 4 is lifted over a predetermined angle. Thus, the attachment condition determining part 300 can obtain a rough position of the bucket 6, and can determine whether the bucket 6 is within the predetermined working range. For example, the attachment condition determining part 300 can detect that a ground height of a pivot center of the bucket 6 is over a predetermined value. The attachment condition determining part 300 may determine an attachment condition based on an output of a proximity sensor, which detects that the boom 4 has been lifted to a predetermined climb angle (i.e., which detects a proximity of the boom 4), or the like. In a case of using the proximity sensor, the attachment condition determining part 300 can determine a condition of an attachment in which the boom 4 is being lifted up by detecting that the boom 4 has entered into a climb angle range where the proximity sensor activates. Thus, the attachment condition determining part 300 can obtain a rough position of the bucket 6 and determine whether the bucket 6 is within the working range.

The operating condition switching part 301 is a functional element configured to output a control signal to the engine 11 or the regulator 13 in order to change a horsepower of the main pumps 12L, 12R based on a signal from the attachment condition determining part 300. Specifically, if the attachment condition determining part 300 determines that the attachment is within the predetermined working range, the operating condition switching part 301 outputs a control signal to the engine 11 or the regulator 13. Thus, a horsepower of the main pumps 12L, 12R decreases, and an amount of hydraulic oil supplied to the arm cylinder 8 decreases as well. In this way, the operating condition switching part 301 can not only slow down a movement of the arm 5 but also slow down a movement of the bucket 6.

Figure 3:
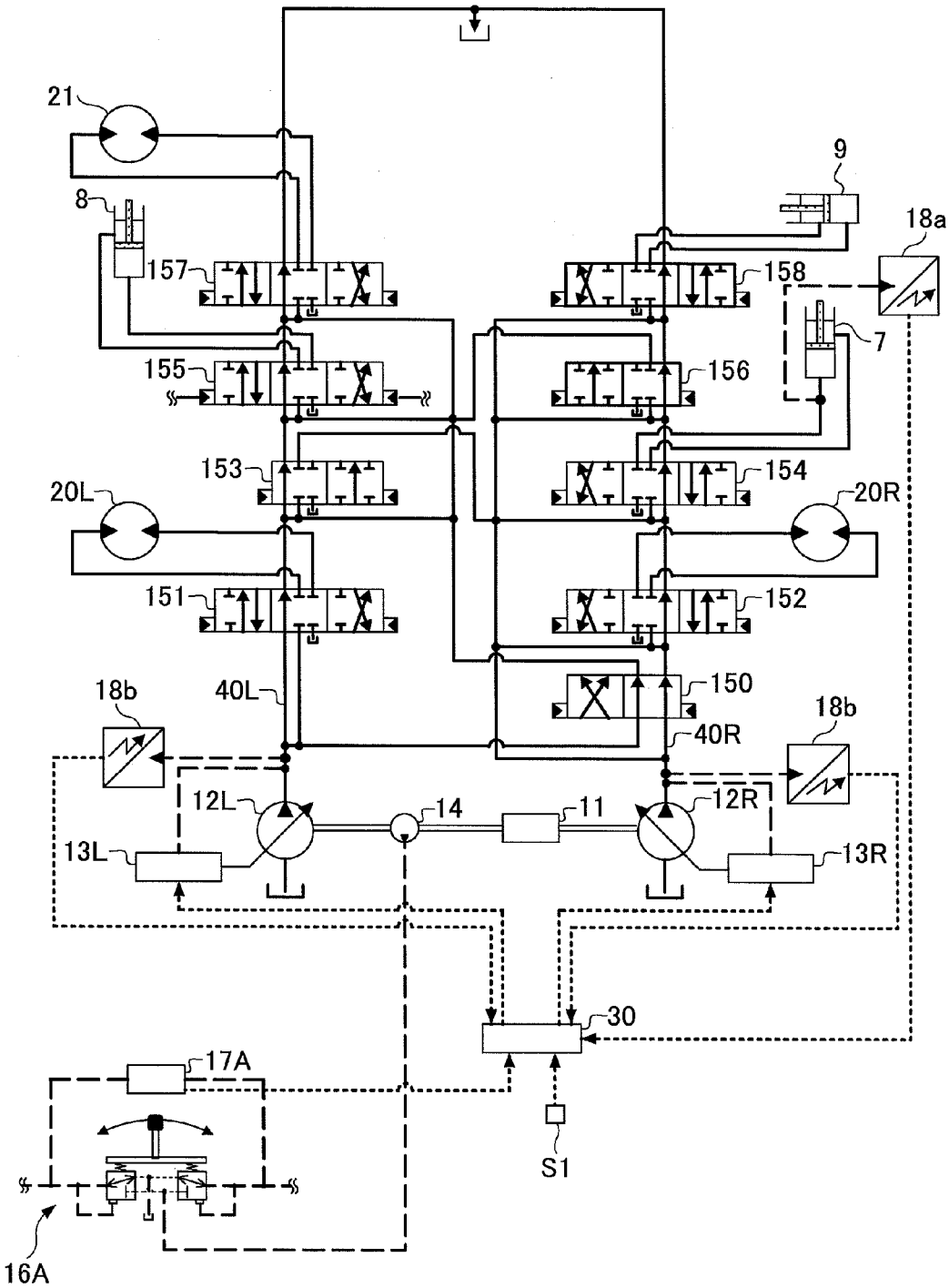
FIG. 3 is a first schematic diagram showing a configuration example of a hydraulic system installed in the hydraulic shovel.

Next, referring to FIG. 3, there will be explained about a mechanism which decreases an amount of hydraulic oil supplied to the arm cylinder 8 and slows down a movement of the arm 5 or the bucket 6. FIG. 3 is a schematic diagram showing a configuration example of the hydraulic system installed in the hydraulic shovel according to the first embodiment. In FIG. 3, as is the case in FIG. 2, a mechanical power system, a high pressure hydraulic line, a pilot line, and an electric drive/control system are indicated by a double line, a solid line, a dashed line, and a dotted line, respectively.

In the first embodiment, the hydraulic system circulates the hydraulic oil from the main pump 12 (two main pumps 12L, 12R) driven by the engine 11 to a hydraulic oil tank via each of center bypass hydraulic lines 40L, 40R.

The center bypass hydraulic line 40L is a high pressure hydraulic line passing through flow control valves 151, 153, 155, and 157 arranged in the control valve 15. The center bypass hydraulic line 40R is a high pressure hydraulic line passing through flow control valves 150, 152, 154, 156, and 158 arranged in the control valve 15.

The flow control valves 153, 154 are spool valves configured to control a flow of the hydraulic oil in order to supply the hydraulic oil discharged from the main pumps 12L, 12R to the boom cylinder 7, and in order to drain the hydraulic oil in the boom cylinder 7 into the hydraulic oil tank. Also, the flow control valve 154 is a spool valve configured to operate all the time when a boom manipulating lever is manipulated (hereinafter referred to as a "first boom flow control valve"). Also, the flow control valve 153 is a spool valve configured to operate only when the boom manipulating lever is manipulated beyond a predetermined amount of manipulation (hereinafter referred to as a "second boom flow control valve").

Also, the flow control valves 155, 156 are spool valves configured to control a flow of the hydraulic oil in order to supply the hydraulic oil discharged from the main pumps 12L, 12R to the arm cylinder 8, and in order to drain the hydraulic oil in the arm cylinder 8 into the hydraulic oil tank. Also, the flow control valve 155 is a spool valve configured to operate all the time when a arm manipulating lever 16A is manipulated (hereinafter referred to as a "first arm flow control valve"). Also, the flow control valve 156 is a spool valve configured to operate only when the arm manipulating lever 16A is manipulated beyond a predetermined amount of manipulation (hereinafter referred to as a "second arm flow control valve").

Also, the flow control valve 157 is a spool valve configured to control a flow of the hydraulic oil in order to circulate the hydraulic oil discharged from the main pump 12L in the hydraulic turning motor 21.

Also, the flow control valve 158 is a spool vale configured to supply the hydraulic oil discharged from the main pump 12R to the bucket cylinder 9, and to drain the hydraulic oil in the bucket cylinder 9 into the hydraulic oil tank.

Also, the regulators 13L, 13R are configured to regulate discharge rates of the main pumps 12L, 12R, by adjusting swash plate tilt angles of the main pumps 12L, 12R depending on discharge pressures of the main pumps 12L, 12R (i.e., under a total horsepower control). Specifically, the regulators 13L, 13R decrease the discharge rates by adjusting the swash plate tilt angles of the main pumps 12L, 12R if the discharge pressures of the main pumps 12L, 12R have become greater than or equal to a predetermined value in order to prevent a pump horsepower, which is represented by a product of its discharge rate and its discharge pressure, from exceeding an output horsepower of the engine 11.

The arm manipulating lever 16A is an example of the manipulation device 16, and a device configured to control opening and closing of the arm 5. The arm manipulating lever 16A uses the hydraulic oil discharged from the pilot pump 14, and applies a control pressure corresponding to an amount of lever manipulation on a left side pilot port or a right side pilot port of the first arm flow control valve 155. In the first embodiment, the arm manipulating lever 16A injects the hydraulic oil into a left side pilot port or a right side pilot port of the second arm flow control valve 156, too, if an amount of lever manipulation is beyond a predetermined amount of manipulation.

A pressure sensor 17A is an example of the pressure sensor 17. The pressure sensor 17A detects an operator's manipulation content (e.g., a direction of lever manipulation and an amount of lever manipulation (an angle of lever manipulation)) to the arm manipulating lever 16A in a form of a pressure, and outputs a detection value to the controller 30.

A left and a right running body manipulating levers (or pedals), a boom manipulating lever, a bucket manipulating lever, and a turning body manipulating lever (all not shown) are manipulation devices configured to control running of the lower running body 1, lifting and lowering of the boom 4, opening and closing of the bucket 6, and turning of the upper turning body 3, respectively. As is the case in the arm manipulating lever 16A, these manipulation devices use the hydraulic oil discharged from the pilot pump 14, and apply a control pressure corresponding to an amount of lever manipulation (or pedal manipulation) on a left side pilot port or a right side pilot port of a flow control valve corresponding to each of the hydraulic actuators. Also, as is the case in the pressure sensor 17A, the operator's manipulation content (the direction and amount of lever manipulation) to each of these manipulation devices is detected by a corresponding pressure sensor in a form of a pressure. Then, the corresponding pressure sensor outputs a detection value to the controller 30.

The controller 30 receives an output of a sensor such as the boom cylinder pressure sensor 18*a*, the discharge pressure sensor 18*b*, a pressure sensor (not shown) configured to detect a negative control pressure as well as outputs of the boom angle sensor S1 and the pressure sensor 17. Then, the controller 30 outputs a control signal to the regulators 13L, 13R.

In the hydraulic system having the above configuration, the operating condition switching part 301 in the controller 30 outputs a control signal to the regulators 13L, 13R as needed, changes a discharge rate of the main pump 12 depending on the control signal, and then changes a horsepower of the main pump 12. Thus, a flow rate of the hydraulic oil supplied to the first arm flow control valve 155 is changed. Also, if the second arm flow control valve 156 is at work, a flow rate of the hydraulic oil supplied to the second arm flow control valve 156 is changed, too. Thus, a flow rate of the hydraulic oil toward the arm cylinder 8 is also changed, and a movement of the arm 5 is also changed. As a result, a movement of the bucket 6 is also changed. Hereinafter, a state where a discharge rate of the main pump 12 is decreased is referred to as a "discharge rate decreased state", and a state before being switched to a discharge rate decreased state is referred to as a "normal state".

The controller 30 may change a flow rate of the hydraulic oil toward the bucket cylinder 9 as well as a flow rate of the hydraulic oil toward the arm cylinder 8.

The "upper working range" represents a working range located above the operator. In the upper working range, a rapid movement of the end attachment is not required because it is difficult for the operator to see the end attachment existing in the working range. Also, the upper working range is preset depending on a shape of the cabin 10, a model (a size) of the hydraulic shovel, or the like.

Figure 4:
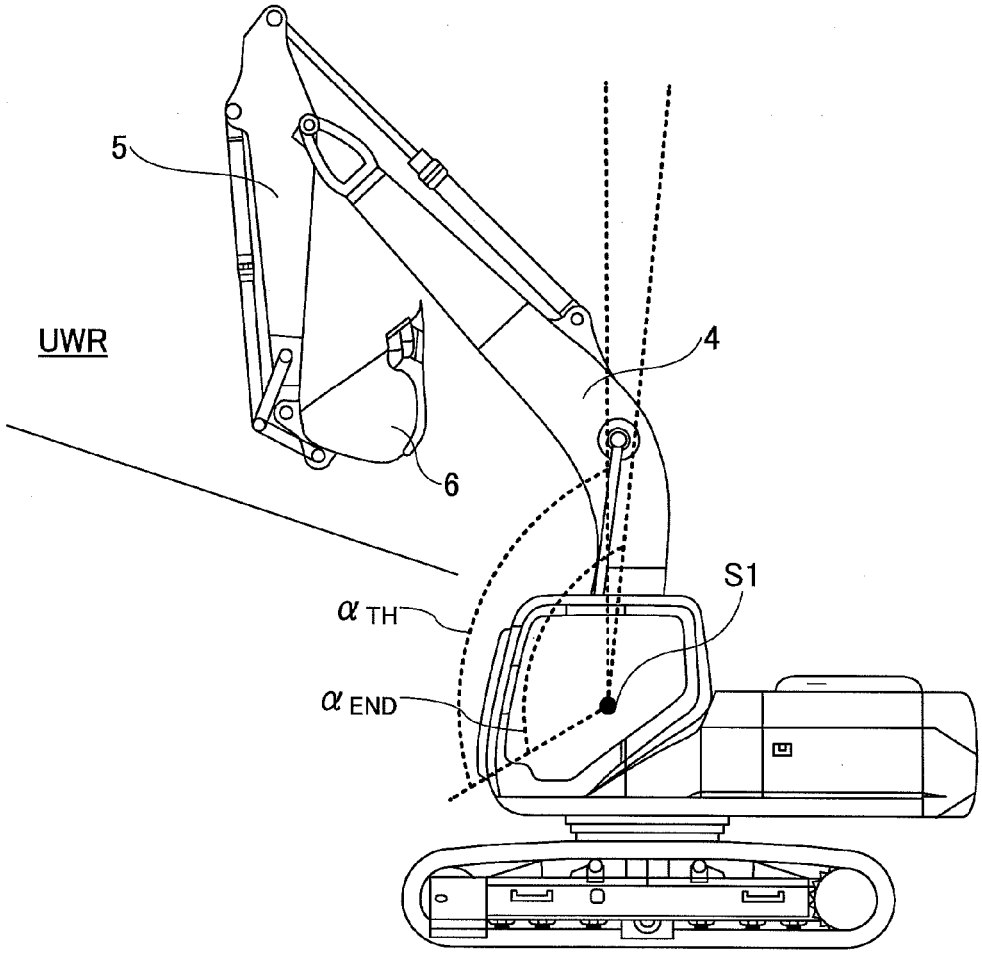
FIG. 4 is a first schematic diagram showing an example of an upper working range.

FIG. 4 is a schematic diagram showing an example of the upper working range. The upper working range UWR is defined based on a value of the boom angle $\alpha$ detected by the boom angle sensor S1, the proximity sensor (not shown), or the like.

For example, the upper working range UWR is defined as an existence range of the attachment if the boom angle $\alpha$ has become greater than or equal to a predetermined value $\alpha_{TH}$. Preferably, the upper working range UWR can be defined as an existence range of the attachment when the boom angle $\alpha$ is within 10° from a maximum angle $\alpha_{END}$ (a boom angle at a most lifted state of the boom 4) (i.e., $\alpha_{END}-\alpha_{TH}\leq 10°$). More preferably, the upper working range UWR can be defined as an existence range of the attachment when the boom angle $\alpha$ is within 5° from the maximum angle $\alpha_{END}$ (i.e., $\alpha_{END}-\alpha_{TH}\leq 5°$).

Figure 5:
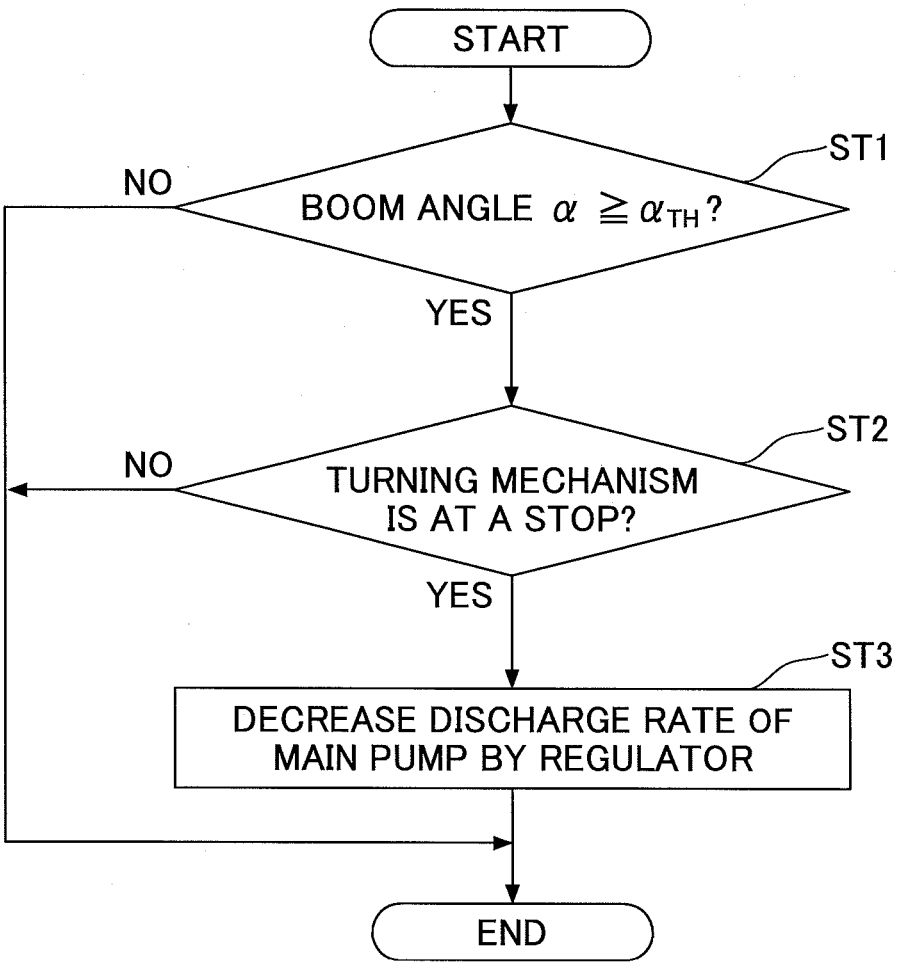
FIG. 5 is a first flowchart showing a flow of an operating condition switchover determining process.

Next, referring to FIG. 5, there will be explained about a process in which the operating condition switching part 301 switches an operating condition of the hydraulic shovel from a normal state to a discharge rate decreased state so that a movement of the arm 5 or the bucket 6 slows down (herein after referred to as an "operating condition switchover determining process"). FIG. 5 is a flowchart showing a flow of the operating condition switchover determining process. The controller 30 repeatedly performs this operating condition switchover determining process at regular intervals until an operating condition of the hydraulic shovel is switched from a normal state to a discharge rate decreased state by the operating condition switching part 301.

Firstly, the attachment condition determining part 300 determines whether the boom angle $\alpha$ is greater than or equal to the predetermined value $\alpha_m$ based on a value of the boom angle $\alpha$ detected by the boom angle sensor S1 (step ST1). In this way, the attachment condition determining part 300 can determine whether the attachment is within the upper working range UWR, and can also determine whether the bucket 6 is within the upper working range UWR, too.

If the attachment condition determining part 300 determines that the bucket 6 is not within the upper working range UWR, i.e., the boom angle $\alpha$ is lower than the predetermined value $\alpha_{TH}$ (NO in step ST1), the operating condition switching part 301 terminates this turn of the operating condition switchover determining process without switching an operating condition of the hydraulic shovel from a normal state to a discharge rate decreased state.

In contrast, if the attachment condition determining part 300 determines that the bucket 6 is within the upper working range UWR, i.e., the boom angle $\alpha$ is greater than our equal to the predetermined value $\alpha_{TH}$ (YES in step ST1), the operating condition switching part 301 determines whether the turning mechanism 2 is at a stop (step ST2). Specifically, the operating condition switching part 301 determines whether the turning mechanism 2 is at a stop by detecting an amount of lever manipulation of the turning body manipulating lever (not shown) based on a detection value of the pressure sensor 17.

If the operating condition switching part 301 determines that the turning mechanism 2 is not at a stop, i.e., that the upper turning body 3 is turning (NO in step ST2), the operating condition switching part 301 terminates this turn of the operating condition switchover determining process without switching operating conditions of the hydraulic shovel from a normal state to a discharge rate decreased state.

In contrast, if the operating condition switching part 301 determines that the turning mechanism 2 is at a stop, i.e., that the upper turning body 3 is not turning (YES in step ST2), the operating condition switching part 301 decreases discharge rates of the main pumps 12L, 12R so that movements of the hydraulic actuators slow down (step ST3). Specifically, the operating condition switching part 301 outputs a control signal to the regulators 13L, 13R, adjusts the regulators 13L, 13R, and decreases discharge rates of the main pumps 12L, 12R.

In this way, if the attachment condition determining part 300 determines that the boom angle $\alpha$ is greater than or equal to the predetermined value $\alpha_{TH}$, the operating condition switching part 301 decreases a flow rate of the hydraulic oil which circulates in the arm cylinder 8 to a level lower than the usual level by decreasing discharge rates of the main pumps 12L, 12R.

Specifically, the operating condition switching part 301 decreases a flow rate of the hydraulic oil flowing into the first arm flow control valve 155 to a level lower than the usual level, even if the arm manipulating lever 16A is manipulated and the first arm flow control valve 155 is at work. Also, the operating condition switching part 301 decreases a flow rate of the hydraulic oil flowing into each of the first arm flow control valve 155 and the second arm flow control valve 156 to a level lower than the usual level, even if the arm manipulating lever 16A is manipulated beyond a predetermined amount of manipulation and both the first arm flow control valve 155 and the second flow control valve 156 are at work. As a result, the operating condition switching part 301 can decrease a flow rate of the hydraulic oil flowing into the arm cylinder 8 and slow down a movement of the arm 5.

In this way, the operating condition switching part 301 can improve energy efficiency by curbing unnecessary energy consumption (e.g., unnecessary fuel consumption) caused by moving the arm 5 or the bucket 6 rapidly despite no need to move the arm 5 or the bucket 6 rapidly.

Figure 6:
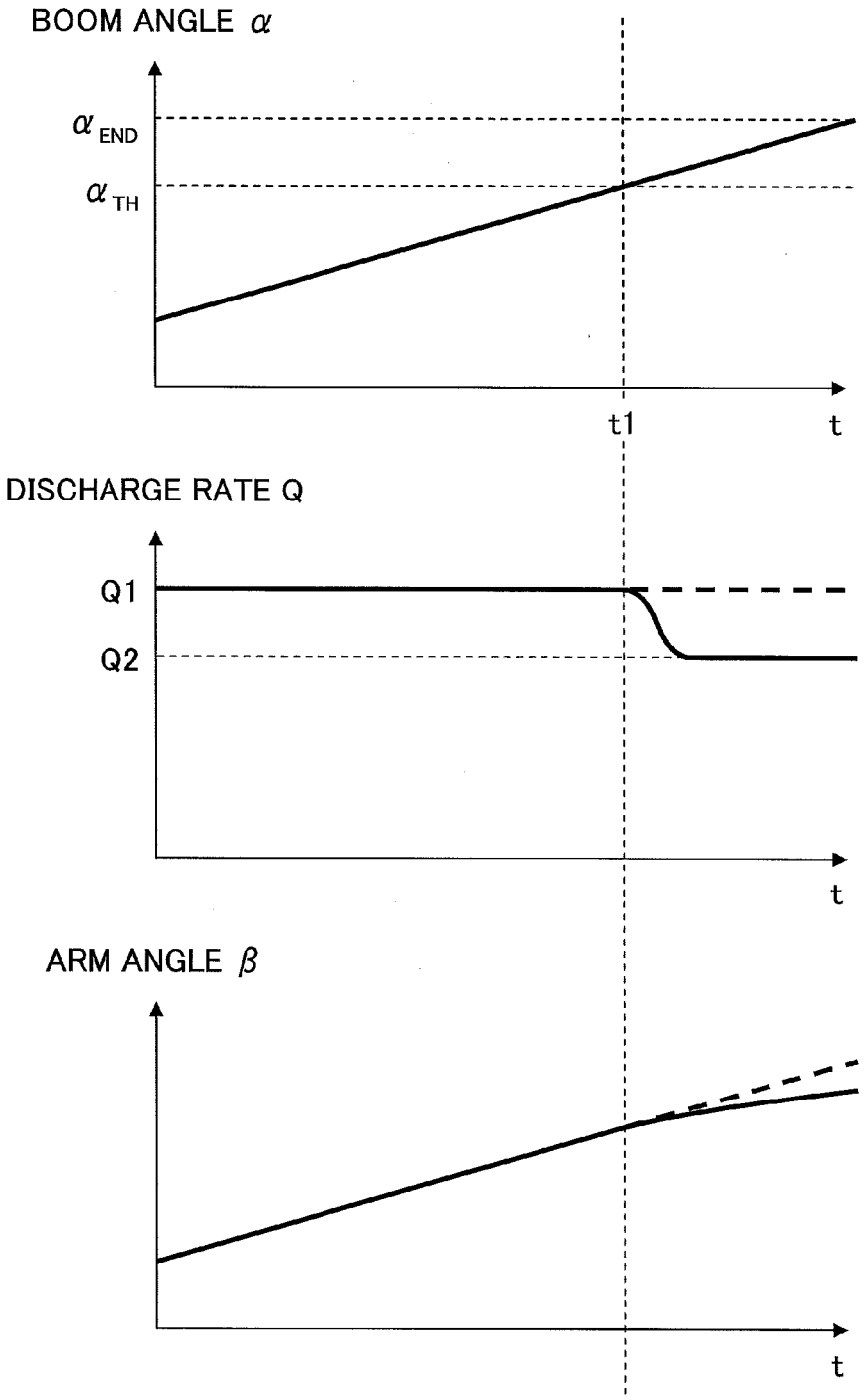
FIG. 6 is a diagram showing changes in a boom angle, a discharge rate, and an arm angle during a switchover from a normal state to a discharge rate decreased state caused by an adjustment of a regulator.

Next, referring to FIG. 6, there will be explained about temporal changes in a boom angle $\alpha$, a discharge rate Q, and an arm angle $\beta$ (open angle from a most closed state of the arm 5) in a case where the operating condition switching part 301 switches an operating condition of the hydraulic shovel from a normal state to a discharge rate decreased state. In FIG. 6, the operator of the hydraulic shovel performs a combined manipulation for lifting the boom 4 and opening the arm 5. An amount of lever manipulation of the boom manipulating lever (not shown) and that of the arm manipulating lever 16A are constant. Also, a discharge rate decreased state is achieved by adjusting the regulators 13L, 13R. Also, the discharge rate Q simultaneously indicates a discharge rate of each of the main pumps 12L, 12R. That is, discharge rates of the main pumps 12L, 12R follow the same trajectory.

As shown in FIG. 6, the attachment condition determining part 300 determines that the attachment has entered into the upper working range UWR if the boom angle $\alpha$ has become greater than or equal to the predetermined value $\alpha_{TH}$ (a value smaller than the maximum angle $\alpha_{END}$ at a most lifted state of the boom 4 by a predetermined angle (e.g., 5 degrees)) at a time point t1. Thus, the attachment condition determining part 300 determines that the bucket 6 has entered into the upper working range UWR.

Subsequently, the operating condition switching part 301 decreases the discharge rate Q of the main pumps 12L, 12R from a discharge rate Q1 (e.g., 220 liters per minute) at a normal state to a predetermined discharge rate Q2 (e.g., 160 liters per minute) by adjusting the regulators 13L, 13R. In this way, the operating condition switching part 301 can decrease a horsepower of the main pumps 12L, 12R by decreasing the discharge rate Q of the main pumps 12L, 12R. As a result of a decrease in a horsepower of the main pumps 12L, 12R, an increasing (opening) rate of the arm angle $\beta$ decreases, as indicated by a solid line, in comparison to a case where the discharge rate is not decreased (see a dashed line).

The changes shown in FIG. 6 can also be applied to a case where other combined manipulations such as a combined manipulation for lifting the boom 4 and closing the arm 5 are performed.

Also, in the first embodiment, the operating condition switching part 301 terminates the operating condition switchover determining process without slowing down a movement of the arm 5 or the bucket 6, if the operating condition switching part 301 determines that the turning mechanism 2 is not at a stop, i.e., that the upper turning body 3 is turning, even if the attachment condition determining part 300 determines that the boom angle $\alpha$ is greater than or equal to the predetermined value $\alpha_{TH}$. This is to prevent an operator from having a feeling of strangeness due to the fact that a turning speed of the upper turning body 3 decreases as soon as the bucket 6 has entered into the upper working range UWR when an operator has lifted the boom 4 while turning the upper turning body 3.

In this regard, the operating condition switching part 301 may terminate the operating condition switchover determining process without switching the operating conditions, if the operating condition switching part 301 determines that the hydraulic running motors 20L, 20R, or other end attachments (e.g., a breaker, or the like) attached instead of the bucket 6 are at work, even if the attachment condition determining part 300 determines that the boom angle $\alpha$ is greater than or equal to the predetermined value $\alpha_{TH}$, in order to obtain the similar effect. In this case, for example, the operating condition switching part 301 may terminate the operating condition switchover determining process without slowing down a movement of the arm 5 or the bucket 6, if the operating condition switching part 301 determines that the lower running body 1 is running, even if the attachment condition determining part 300 determines that the boom angle $\alpha$ is greater than or equal to the predetermined value $\alpha_{TH}$.

In this way, the operating condition switching part 301 can slow down a movement pace of the attachment by decreasing the discharge rate of the main pump 12.

Also, after slowing down the movement of the attachment, the operating condition switching part 301 restores the movement pace of the attachment to its original state, if a predetermined manipulation (e.g., a manipulation for turning the turning mechanism 2) is performed, or if the operating condition switching part 301 determines that the boom angle $\alpha$ is lower than the predetermined value $\alpha_{TH}$.

Figure 7:
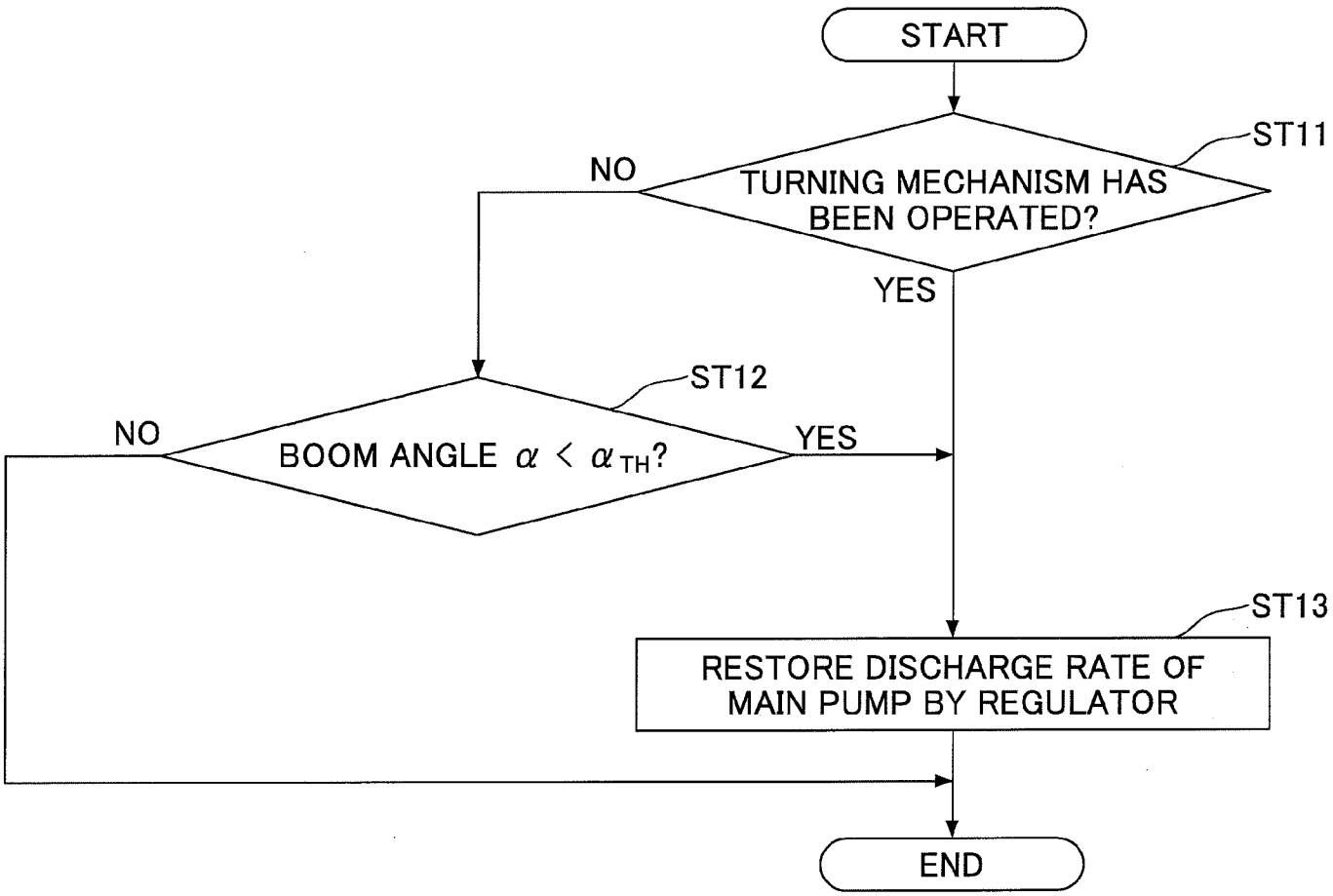
FIG. 7 is a first flowchart showing a flow of an operating condition restoring process.

Next, referring to FIG. 7, there will be explained about a process for switching operating conditions of the hydraulic shovel from a discharge rate decreased state to a normal state in order to restore a movement of the end attachment to its original state (hereinafter referred to as an "operating condition restoring process"). FIG. 7 is a flowchart showing a flow of the operating condition restoring process. The controller 30 repeatedly performs this operating condition restoring process at regular intervals until the operating condition of the hydraulic shovel is restored to its original state by the operating condition switching part 301.

Firstly, the operating condition switching part 301 determines whether the turning mechanism 2 has been operated by detecting an amount of lever manipulation of the turning body manipulating lever (not shown) based on a detection value of the pressure sensor 17 (step ST11).

If the operating condition switching part 301 determines that the turning mechanism 2 is not operated (NO in step ST11), the operating condition switching part 301 determines whether the bucket 6 has deviated from the upper working range UWR by determining whether the boom angle $\alpha$ is lower than the predetermined value $\alpha_{TH}$ based on a value of the boom angle $\alpha$ obtained by the attachment condition determining part 300 (step ST12).

If the operating condition switching part 301 determines that the bucket 6 has not deviated from the upper working range UWR yet, i.e., if the boom angle $\alpha$ is greater than or equal to the predetermined value $\alpha_{TH}$ (NO in step ST12), the operating condition switching part 301 terminates this turn of the operating condition restoring process without restoring the operating condition of the hydraulic shovel from a discharge rate decreased state to a normal state.

In contrast, if the boom angle $\alpha$ is lower than the predetermined value $\alpha_{TH}$ (YES in step ST12), the operating condition switching part 301 restores the operating condition of the hydraulic shovel from a discharge rate decreased state to a normal state (step ST13). Specifically, the operating condition switching part 301 restores the regulators 13L, 13R to their original state in order to restore a movement of the arm 5 or the bucket 6 to its original state.

Also, even before the boom angle $\alpha$ becomes lower than the predetermined value $\alpha_{TH}$, if the operating condition switching part 301 determines that the turning mechanism 2 has been operated (NO in step ST11), the operating condition switching part 301 restores the operating condition of the hydraulic shovel from a discharge rate decreased state to a normal state (step ST13). This is to turn the turning mechanism 2 at a speed of a normal state, and to prevent an operator from having a feeling of strangeness due to the decreased turning speed.

Also, even before the boom angle $\alpha$ becomes lower than the predetermined value $\alpha_{TH}$, if the operating condition switching part 301 determines that the boom 4 or the hydraulic running motors 20L, 20R have been operated, the operating condition switching part 301 may restore the operating condition of the hydraulic shovel from a discharge rate decreased state to a normal state. This is to move the boom 4 or the hydraulic running motors 20L, 20R at a speed of a normal state.

To put the above another way, as far as the boom angle $\alpha$ is greater than or equal to the predetermined value $\alpha_{TH}$, even if the arm 5 or the bucket 6 has been operated, the operating condition switching part 301 continues a low speed motion of the arm 5 or the bucket 6.

Figure 8:
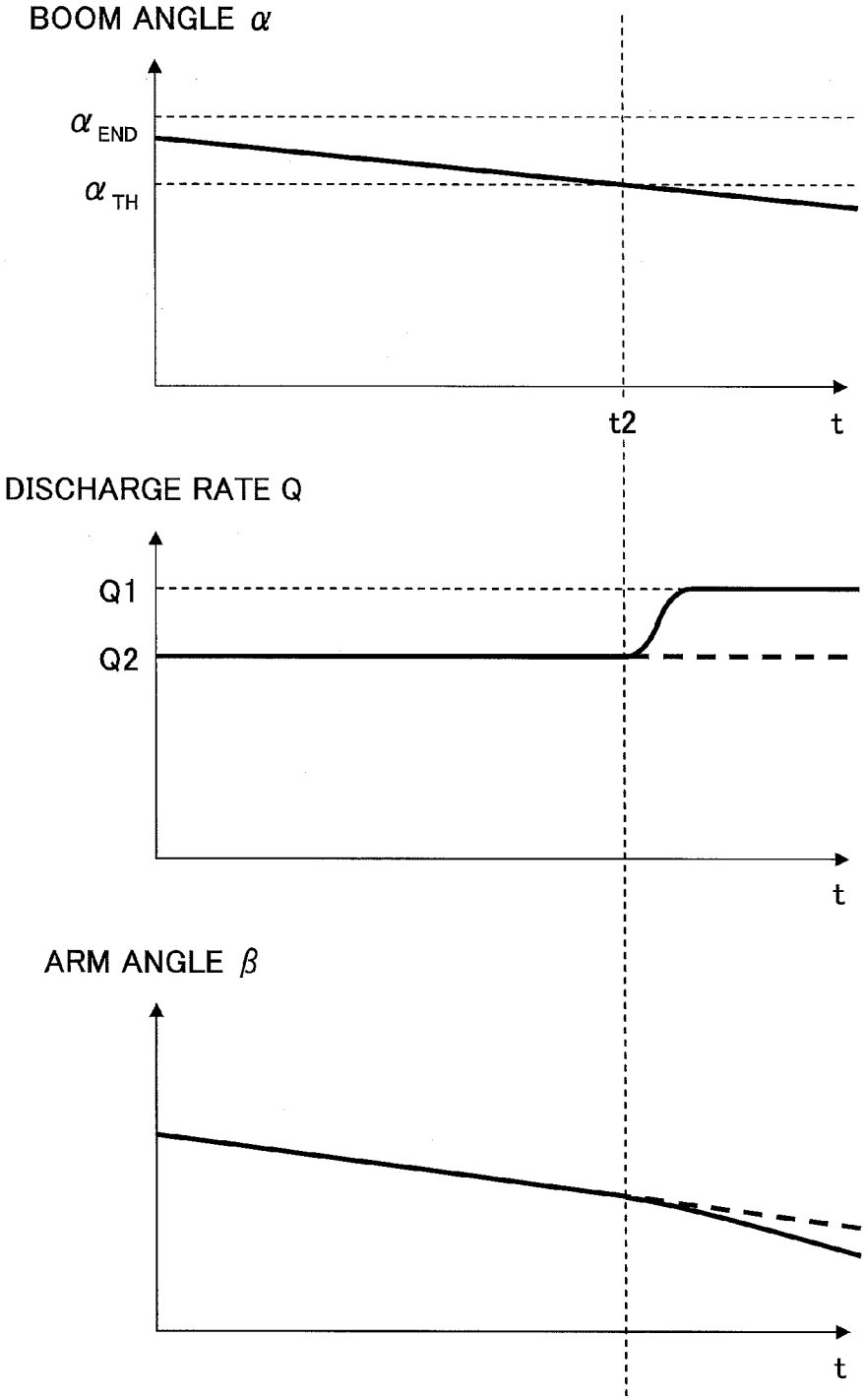
FIG. 8 is a diagram showing changes in a boom angle, a discharge rate, and an arm angle during a switchover from a discharge rate decreased state to a normal state caused by an adjustment of a regulator.

Next, referring to FIG. 8, there will be explained about temporal changes in a boom angle $\alpha$, a discharge rate Q, and an arm angle $\beta$ in a case where the operating condition switching part 301 switches an operating condition of the hydraulic shovel from a discharge rate decreased state to a normal state. In FIG. 8, the operator of the hydraulic shovel performs a combined manipulation for lowering the boom 4 and closing the arm 5. An amount of lever manipulation of the boom manipulating lever and that of the arm manipulating lever 16A are constant. Also, a discharge rate decreased state is achieved by adjusting the regulators 13L, 13R. Also, the discharge rate Q simultaneously indicates a discharge rate of each of the main pumps 12L, 12R.

As shown in FIG. 8, the boom angle $\alpha$ becomes lower than the predetermined value $\alpha_{TH}$ at a time point t2, and the operating condition switching part 301 determines that the bucket 6 has deviated from the upper working range UWR.

Subsequently, the operating condition switching part 301 restores the regulators 13L, 13R to their original state, and restores the discharge rate Q of the main pumps 12L, 12R from the discharge rate Q2 (e.g., 160 liters per minute) at a discharge rate decreased state to the discharge rate Q1 (e.g., 220 liters per minute) at a normal state. As a result of the restoration of the discharge rate Q of the main pumps 12L, 12R, a decreasing (closing) rate of the arm angle $\beta$ increases, as indicated by a solid line, in comparison to a case where the discharge rate is not restored (see a dashed line).

The changes shown in FIG. 8 can also be applied to a case where other combined manipulations such as a combined manipulation for lowering the boom 4 and opening the arm 5 are performed.

Also, even if the operating condition switching part 301 determines that the boom angle $\alpha$ has become lower than the predetermined value $\alpha_{TH}$, if the operating condition switching part 301 detects that any one of the hydraulic actuators is at work based on a detection value of the pressure sensor 17, the operating condition switching part 301 may inhibit the restoration to a normal state. This is to prevent an operator from having a feeling of strangeness due to the fact that, in case of lowering the boom 4 for example, a lowering speed of the boom 4 increases as soon as the boom angle $\alpha$ has become lower than the predetermined value $\alpha_{rx}$.

Also, if the operating condition of the hydraulic shovel is switched by the operating condition switching part 301, the controller 30 may inform the operator that the operating condition has been switched by outputting a control signal to a display device, audio output device (both not shown), or the like installed in the cabin 10.

According to the above configuration, the shovel according to the first embodiment decreases the discharge rate of the main pump 12 if the boom angle $\alpha$ is greater than or equal to the predetermined value $\alpha_{TH}$. Thus, the hydraulic shovel can improve energy efficiency by curbing unnecessary energy consumption (e.g., unnecessary fuel consumption) caused by moving the arm 5 or the bucket 6 rapidly despite no need to move the arm 5 or the bucket 6 rapidly.

Also, even if the boom angle $\alpha$ is greater than or equal to the predetermined value $\alpha_{TH}$, if the upper turning body 3 is turning, the hydraulic according to the first embodiment inhibits a switchover from a normal state to a discharge rate decreased state. Thus, the hydraulic shovel can prevent the operator from having a feeling of strangeness due to the fact that a turning speed of the upper turning body 3 and a lifting speed of the boom 4 decrease as soon as the arm 5 or the bucket 6 has entered into the upper working range UWR when the operator has lifted the boom 4 while turning the upper turning body 3.

Also, once the operating condition has been switched from a normal state to a discharge rate decreased state, even if the arm 5 or the bucket 6 has been operated, the hydraulic shovel according to the first embodiment continues a discharge rate decreased state. Thus, the hydraulic shovel can further improve the energy efficiency by curbing unnecessary energy consumption (e.g., unnecessary fuel consumption) for longer periods of time.

Also, the hydraulic shovel according to the first embodiment can estimate a rough position of the bucket 6 by determining the attachment condition based on the climb angle of the boom 4, and can determine whether the bucket 6 is within the upper working range UWR. Thus, the hydraulic shovel can achieve the above effects through using a simple device configuration.

An example using the boom angle sensor S1 as a boom operating condition detecting part is shown here. However, a boom cylinder pressure sensor 18*a* (see FIG. 2) may be used as the boom operating condition detecting part. When the boom 4 is lifted, a position of the center of gravity of the attachment changes, and a detection value of the boom cylinder pressure sensor 18*a* (see FIG. 2) changes, too. Thus, the hydraulic shovel can determine whether the boom 4 has been lifted beyond a predetermined angle by setting a threshold value for a pressure in the boom cylinder 7. Also, the hydraulic shovel can determine whether the attachment is within the upper working range UWR. In this way, the hydraulic shovel can obtain a rough position of the bucket 6, and can determine whether the bucket 6 is within the upper working range UWR.

Also, a discharge pressure of the main pump 12 increases with an increase in a pressure detected by the boom cylinder pressure sensor 18*a* (see FIG. 2). Thus, the hydraulic shovel may determine whether the boom 4 has been lifted beyond the predetermined angle by using the discharge pressure sensor 18*b* (see FIG. 2) as the boom operating condition detecting part.

Moreover, the hydraulic shovel may determine whether the boom 4 has been lifted beyond the predetermined angle by using a sensor configured to detect a stroke amount of the boom cylinder 7 as the boom operating condition detecting part.

Also, the hydraulic shovel according to the first embodiment decreases the discharge rate of the main pump 12 by adjusting the regulator 13. Thus, the hydraulic shovel can improve energy efficiency of the hydraulic shovel at a discharge rate decreased state easily and reliably.

In this way, the hydraulic shovel according to the first embodiment keeps the arm 5 pivotable across an entire angular range, even if the hydraulic shovel has determined that the boom 4 is within the upper working range UWR. Thus, if work is necessary, the hydraulic shovel can continue the work at a decreased output state.

Also, when the bucket 6 has entered into the upper working range UWR, the hydraulic shovel according to the first embodiment decreases a horsepower of the main pump 12 independently of a distance between the bucket 6 and the cabin 10. Thus, the hydraulic shovel can continue to work even at a situation where the cabin 10 is close to a work object such as a building, a rock, or the like.

Also, the hydraulic shovel according to the first embodiment decreases or restores the discharge rate by adjusting the regulator 13 based on the determination of the attachment condition. However, the hydraulic shovel does not always have to restore the discharge rate to achieve an objective of the present invention.

Second Embodiment

Next, referring to FIGS. 9-12, there will be explained about a hydraulic shovel according to a second embodiment of the present invention.

In the hydraulic shovel according to the second embodiment, the operating condition switching part 301 in the controller 30 outputs a control signal to the engine 11 as needed, and decreases a rotational speed of the engine 11. For example, the operating condition switching part 301 decreases a rotational speed of the engine 11 rotating at 1800 rpm by 100-200 rpm.

In this way, the hydraulic shovel according to the second embodiment differs from the hydraulic shovel according to the first embodiment which uses an adjustment of the regulators 13L, 13R in that the hydraulic shovel according to the second embodiment slows down a movement of the arm 5 or the bucket 6 by decreasing the rotational speed of the engine 11. Otherwise, both are common.

Thus, there will be explained about the differences in detail while omitting an explanation of the common points. Also, the same reference numbers as those used for explaining the hydraulic shovel according to the first embodiment are used.

Figure 9:
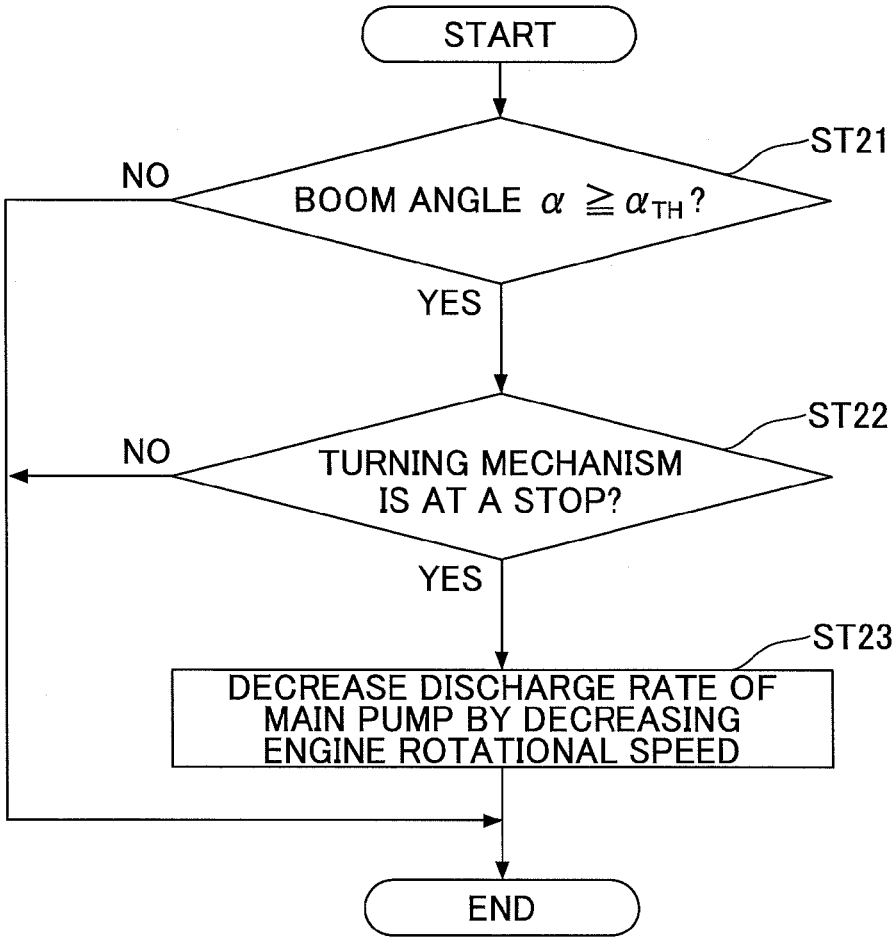
FIG. 9 is a second flowchart showing a flow of the operating condition switchover determining process.

FIG. 9 is a flowchart showing a flow of an operating condition switchover determining process in the hydraulic shovel according to the second embodiment.

FIG. 9 is characterized in that a procedure for decreasing the discharge rates of the main pumps 12L, 12R in step ST23 is achieved by decreasing an engine rotational speed, and that it is different from the procedure achieved by adjusting the regulators 13L, 13R in step ST3 of FIG. 5.

Specifically, if the operating condition switching part 301 determines that the turning mechanism 2 is at a stop, i.e., that the upper turning body 3 is not turning (YES in step ST22), the operating condition switching part 301 decreases the discharge rates of the main pumps 12L, 12R by decreasing the rotational speed of the engine 11 through an output of a control signal to the engine 11 in order to slow a movement of the hydraulic actuator (step ST23).

This is to improve energy efficiency by curbing unnecessary energy consumption (e.g., unnecessary fuel consumption) caused by moving the arm 5 or the bucket 6 rapidly despite no need to move the arm 5 or the bucket 6 rapidly.

Figure 10:
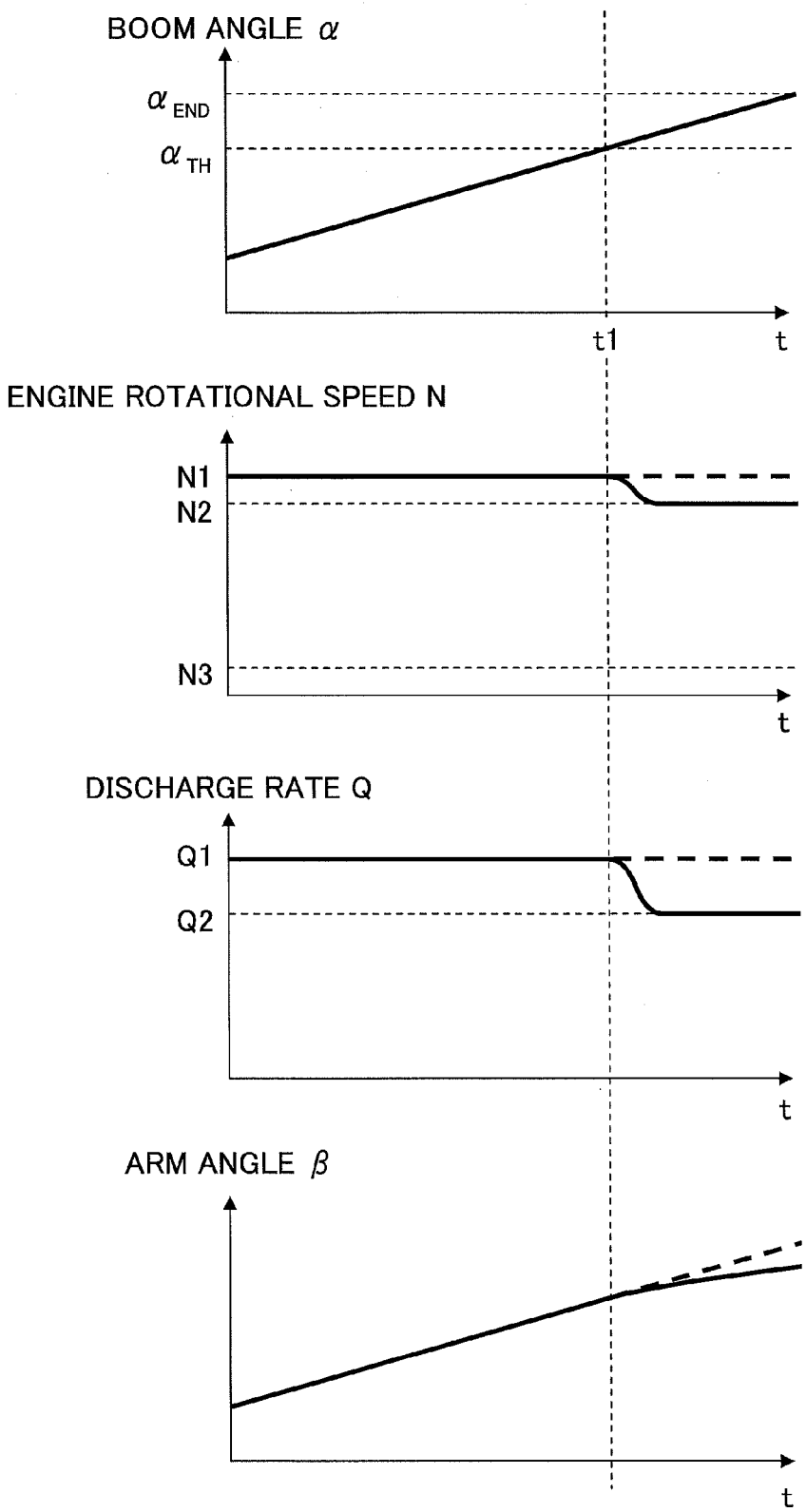
FIG. 10 is a diagram showing changes in a boom angle, an engine rotational speed, a discharge rate, and an arm angle during a switchover from a normal state to a discharge rate decreased state caused by a slow down of the engine rotational speed.

FIG. 10 shows temporal changes in a boom angle $\alpha$, an engine rotational speed N, a discharge rate Q, and an arm angle $\beta$ in a case where the operating condition switching part 301 switches an operating condition of the hydraulic shovel from a normal state to a discharge rate decreased state by decreasing an engine rotational speed. In FIG. 10, the operator of the hydraulic shovel performs a combined manipulation for lifting the boom 4 and opening the arm 5. An amount of lever manipulation of the boom manipulating lever (not shown) and that of the arm manipulating lever 16A are constant. Also, a discharge rate decreased state is achieved by decreasing a rotational speed of the engine 11. Also, the discharge rate Q simultaneously indicates a discharge rate of each of the main pumps 12L, 12R.

As shown in FIG. 10, the attachment condition determining part 300 determines that the bucket 6 has entered into the upper working range UWR if the boom angle $\alpha$ has become greater than or equal to the predetermined value $\alpha_{TH}$ (a value smaller than the boom maximum angle $\alpha_{END}$ at a most lifted state of the boom 4 by a predetermined angle (e.g., 5 degrees)) at a time point t1.

Subsequently, the operating condition switching part 301 decreases the discharge rate Q of the main pumps 12L, 12R from a discharge rate Q1 (e.g., 220 liters per minute) at a normal state to a predetermined discharge rate Q2 (e.g., 160 liters per minute). Specifically, the operating condition switching part 301 decreases the engine rotational speed N of the engine 11 from an engine rotational speed N1 (e.g., 1800 rpm) at a normal state to a predetermined engine rotational speed N2 (e.g., 1700 rpm). This is because the output shaft of the engine 11 is directly coupled to the input shafts of the main pumps 12L, 12R, and because the rotational speed of the input shafts of the main pumps 12L, 12R decreases with a decrease in the rotational speed of the output shaft of the engine 11. Also, this is because the discharge rates of the main pumps 12L, 12R decrease with a decrease in the rotational speed of the input shafts of the main pumps 12L, 12R. In this way, the operating condition switching part 301 can decrease a horsepower of the main pumps 12L, 12R by decreasing the discharge rate Q of the main pumps 12L, 12R. Also, an engine rotational speed N3 represents an engine rotational speed (e.g., 1000 rpm) during idling.

As a result of a decrease in a horsepower of the main pumps 12L, 12R, an increasing (opening) rate of the arm angle $\beta$ decreases, as indicated by a solid line, in comparison to a case where the discharge rate is not decreased (see a dashed line).

Figure 11:
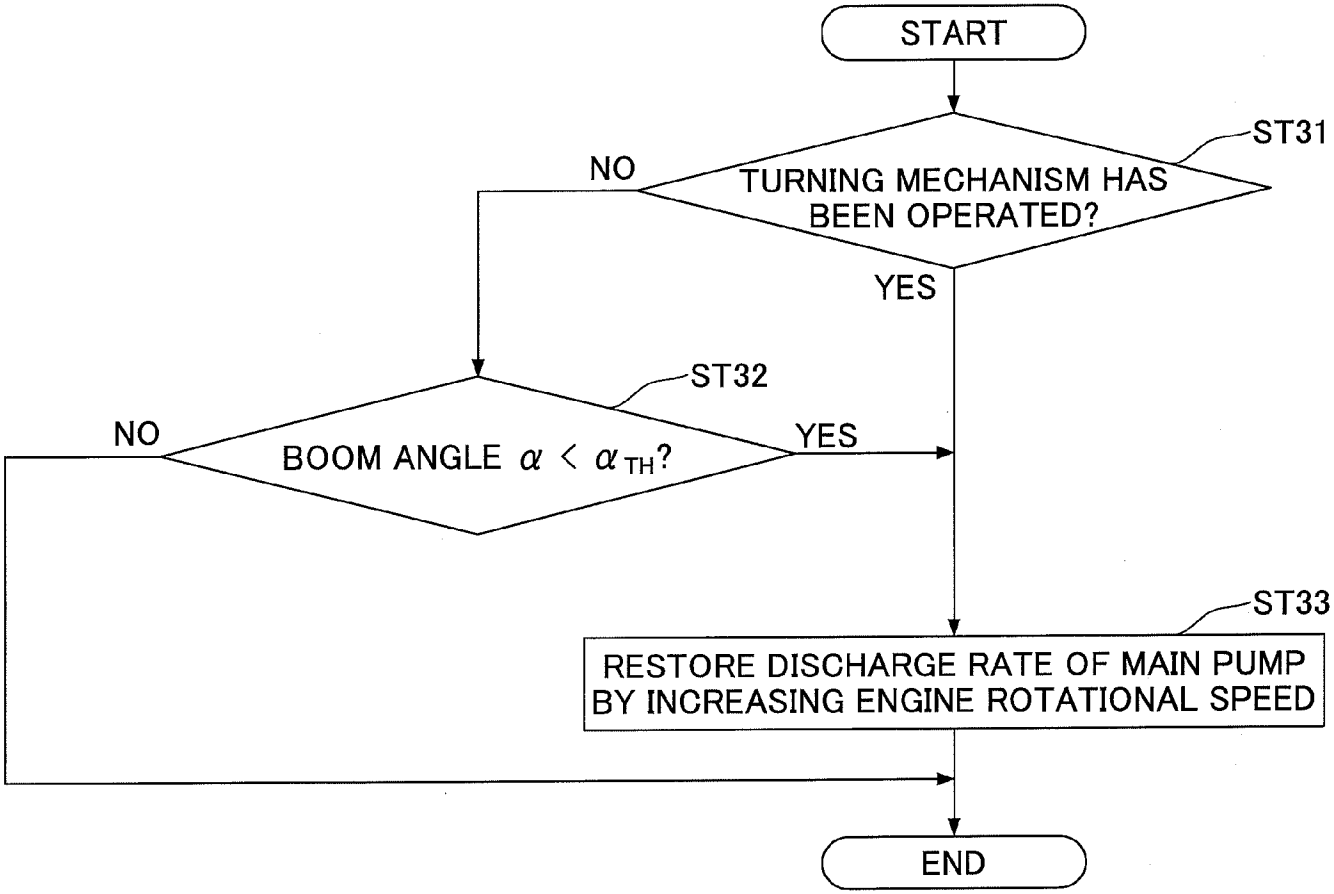
FIG. 11 is a second flowchart showing a flow of the operating condition restoring process.

FIG. 11 is a flowchart showing a flow of an operating condition restoring process in the hydraulic shovel according to the second embodiment.

FIG. 11 is characterized in that a procedure for restoring the discharge rates of the main pumps 12L, 12R in step ST33 is achieved by increasing an engine rotational speed, and that it is different from the procedure achieved by adjusting the regulators 13L, 13R in step ST13 of FIG. 7.

Specifically, if the operating condition switching part 301 determines that the boom angle α has become lower than the predetermined value $\alpha_{TH}$, i.e., that the boom angle α is lower than the predetermined value $\alpha_{TH}$ (YES in step ST32), the operating condition switching part 301 restores the operating condition of the hydraulic shovel from a discharge rate decreased state to a normal state (step ST33). Specifically, the operating condition switching part 301 restores the engine rotational speed of the engine 11 to its original state in order to restore the movement pace of the arm 5 or the bucket 6 to its original state.

Also, even before the bucket 6 deviates from the upper working range UWR, if the operating condition switching part 301 determines that the turning mechanism 2 has been operated (NO in step ST31), the operating condition switching part 301 restores the operating condition of the hydraulic shovel from a discharge rate decreased state to a normal state (step ST33). This is to turn the turning mechanism 2 at a speed of a normal state, and to prevent an operator from having a feeling of strangeness due to the decreased turning speed.

Figure 12:
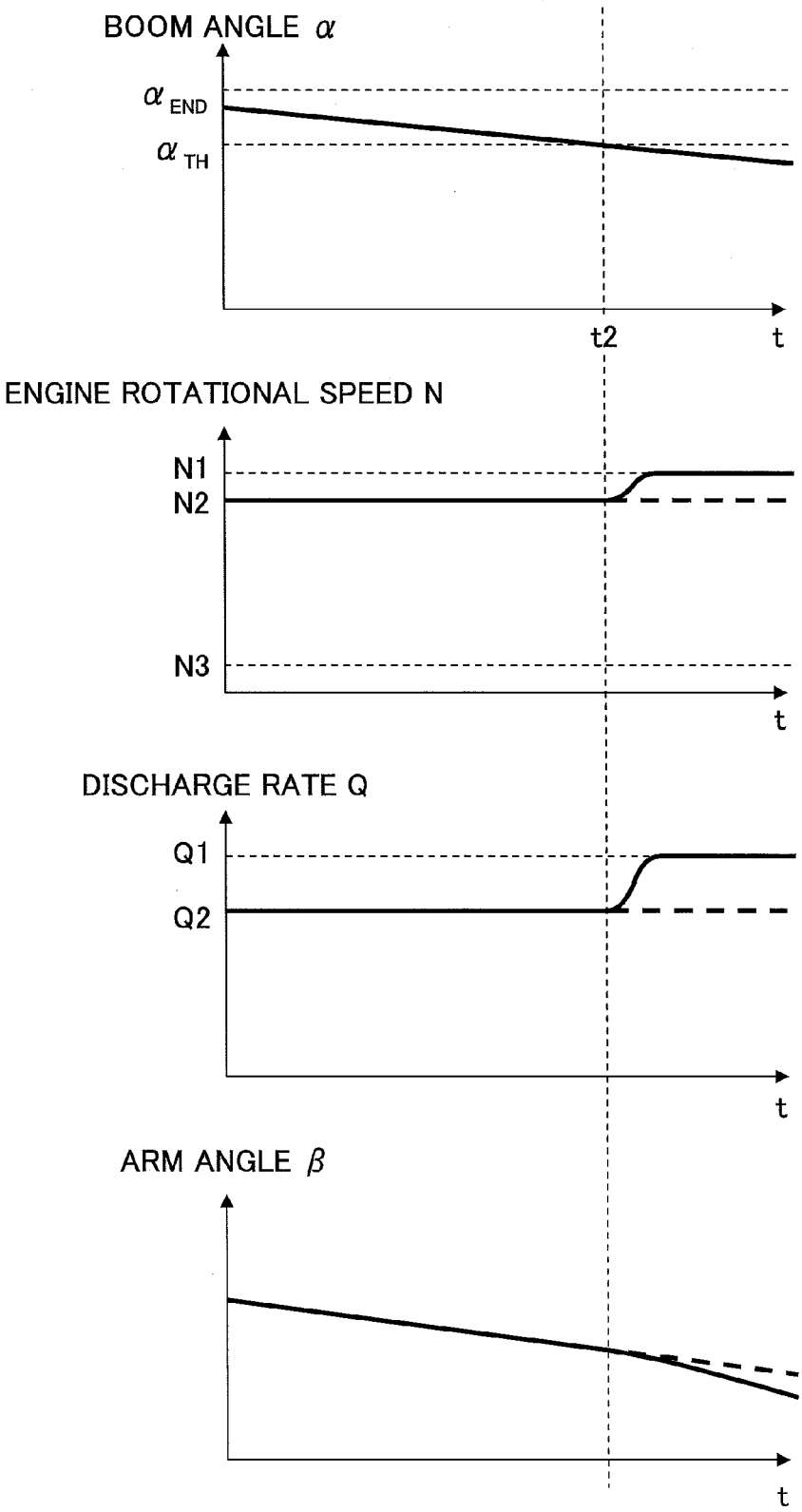
FIG. 12 is a diagram showing changes in a boom angle, an engine rotational speed, a discharge rate, and an arm angle during a switchover from a discharge rate decreased state to a normal state caused by a slow down of the engine rotational speed.

FIG. 12 shows temporal changes in a boom angle α, an engine rotational speed N, a discharge rate Q, and an arm angle β in a case where the operating condition switching part 301 switches an operating condition of the hydraulic shovel from a discharge rate decreased state to a normal state by increasing an engine rotational speed.

As shown in FIG. 12, the operating condition switching part 301 determines that the bucket 6 has deviated from the upper working range UWR if the boom angle α has become lower than the predetermined value $\alpha_{TH}$ at a time point t2.

Subsequently, the operating condition switching part 301 restores the discharge rate Q of the main pumps 12L, 12R from the discharge rate Q2 (e.g., 160 liters per minute) at a discharge rate decreased state to the discharge rate Q1 (e.g., 220 liters per minute) at a normal state. Specifically, the operating condition switching part 301 restores the engine rotational speed N of the engine 11 from the engine rotational speed N2 (e.g., 1700 rpm) at a discharge rate decreased state to the engine rotational speed N1 (e.g., 1800 rpm) at a normal state. As a result of the restoration of the discharge rate Q of the main pumps 12L, 12R, a decreasing (closing) rate of the arm angle β increases, as indicated by a solid line, in comparison to a case where the discharge rate is not restored (see a dashed line).

According to the above configuration, the hydraulic shovel according to the second embodiment can achieve effects similar to the above effects achieved by the hydraulic shovel according to the first embodiment.

An example using the boom angle sensor S1 as a boom operating condition detecting part has been shown here. However, a boom cylinder pressure sensor 18*a* (see FIG. 2) may be used as the boom operating condition detecting part. When the boom 4 is lifted, a position of the center of gravity of the attachment changes, and a detection value of the boom cylinder pressure sensor 18*a* (see FIG. 2) changes, too. Thus, the hydraulic shovel can determine whether the boom 4 has been lifted beyond a predetermined angle by setting a threshold value for a pressure in the boom cylinder 7. Also, the hydraulic shovel can determine whether the attachment is within the upper working range UWR. In this way, the hydraulic shovel can obtain a rough position of the bucket 6, and can determine whether the bucket 6 is within the upper working range UWR.

Also, a discharge pressure of the main pump 12 increases with an increase in a pressure detected by the boom cylinder pressure sensor 18*a* (see FIG. 2). Thus, the hydraulic shovel may determine whether the boom 4 has been lifted beyond the predetermined angle by using the discharge pressure sensor 18*b* (see FIG. 2) as the boom operating condition detecting part.

Moreover, the hydraulic shovel may determine whether the boom 4 has been lifted beyond the predetermined angle by using a sensor configured to detect a stroke amount of the boom cylinder 7 as the boom operating condition detecting part.

Also, the hydraulic shovel according to the second embodiment decreases the discharge rate of the main pump 12 by decreasing the rotational speed of the engine 11. Thus, the hydraulic shovel can improve energy efficiency of the hydraulic shovel at a discharge rate decreased state easily and reliably.

Also, the hydraulic shovel according to the second embodiment decreases or restores the discharge rate by changing the engine rotational speed based on the determination of the attachment condition. However, the hydraulic shovel does not always have to restore the discharge rate to achieve an objective of the present invention.

Third Embodiment

Next, referring to FIGS. 13 and 14, there will be explained about a hydraulic shovel according to a third embodiment of the present invention.

In the hydraulic shovel according to the third embodiment, the operating condition switching part 301 in the controller 30 controls a flow of the hydraulic oil toward a predetermined hydraulic actuator. In what follows, a state where a flow of the hydraulic oil toward the predetermined hydraulic actuator is restricted is referred to as a "supply restricting state".

In this way, the hydraulic shovel according to the third embodiment differs from the hydraulic shovels according to the first and the second embodiments in that the hydraulic shovel according to the third embodiment slows down a movement of the bucket 6 by restricting a flow of the hydraulic oil toward the predetermined hydraulic actuator. Otherwise, both are common.

Thus, there will be explained about the differences in detail while omitting an explanation of the common points. Also, the same reference numbers as those used for explaining the hydraulic shovel according to the first embodiment are used.

Figure 13:
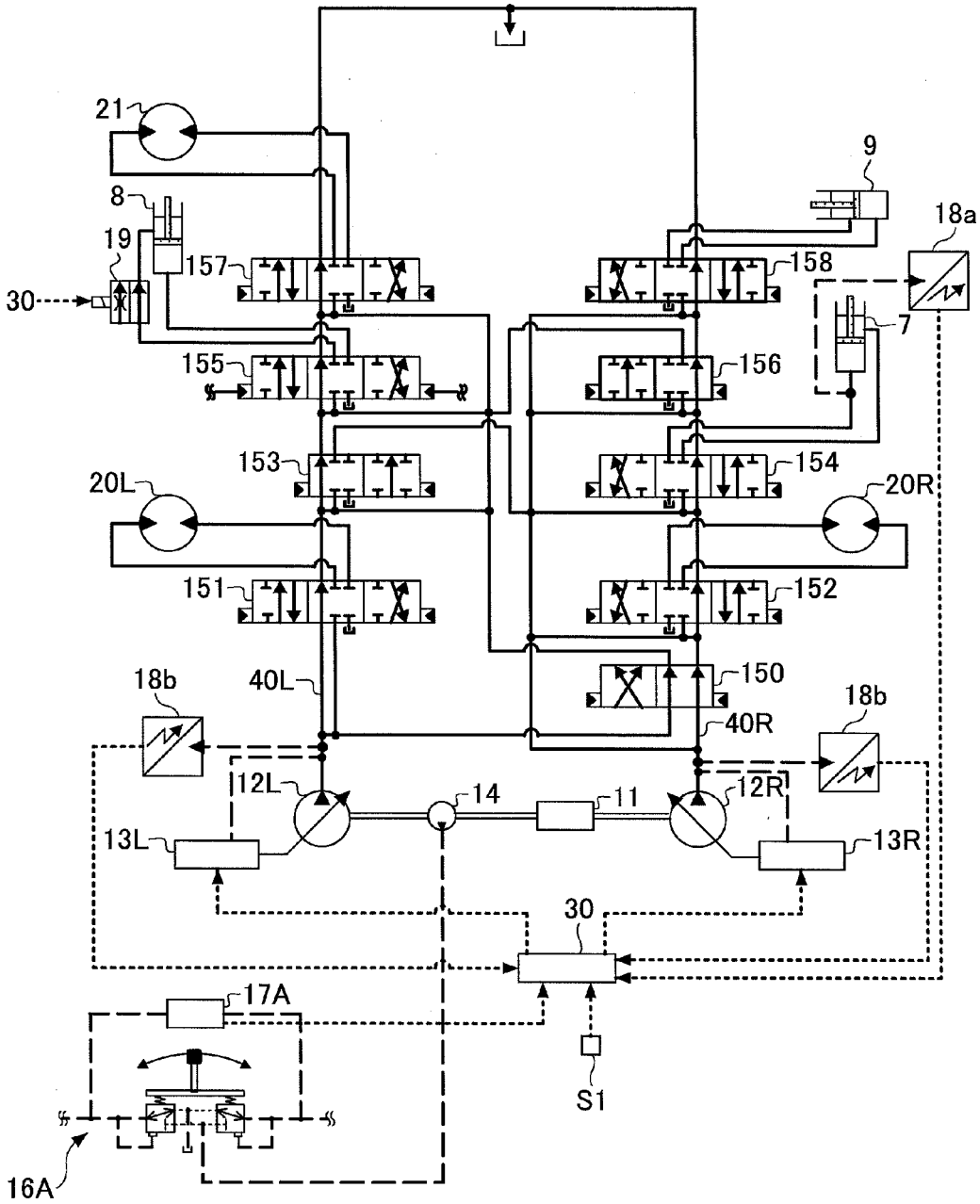
FIG. 13 is a second schematic diagram showing a configuration example of the hydraulic system installed in the hydraulic shovel.

FIG. 13 is a schematic diagram showing a configuration example of the hydraulic system installed in the hydraulic shovel according to the third embodiment. In FIG. 13, as is the case in FIGS. 2 and 3, a mechanical power system, a high pressure hydraulic line, a pilot line, and an electric drive/control system are indicated by a double line, a solid line, a dashed line, and a dotted line, respectively. Also, the hydraulic system in FIG. 13 differs from the hydraulic system in FIG. 3 in that it includes an electromagnetic switching valve 19 and in that the controller 30 outputs a control signal to the electromagnetic switching valve 19. Otherwise, both are common.

The electromagnetic switching valve 19 is a device configured to be able to control a flow of the hydraulic oil toward the hydraulic actuators independently of the flow control valves 150-158, i.e., independently of a manipulation content of the manipulation device 16. The electromagnetic switching valve 19 is, for example, arranged in a high pressure hydraulic line connecting a rod-side chamber of the arm cylinder 8 and the flow control valve 155, and controls a flow of the hydraulic oil toward the arm cylinder 8 in response to the control signal from the controller 30.

The attachment condition determining part 300 in the controller 30 determines whether the bucket 6 has entered into the upper working range UWR. If the attachment condition determining part 300 determines that the bucket 6 has entered into the upper working range UWR, the operating condition switching part 301 slows down a movement of the bucket 6 by outputting a control signal to the electromagnetic switching valve 19 so that a flow of the hydraulic oil toward the arm cylinder 8 is restricted and a movement of the arm 5 slows down.

Also, the operating condition switching part 301 may decrease the discharge rates of the main pumps 12L, 12R as is the case in the hydraulic shovel according to each of the first and the second embodiments. On that basis, the operating condition switching part 301 may output a control signal to the electromagnetic switching valve 19 so that a movement of the bucket 6 slows down. Specifically, the operating condition switching part 301 restricts a flow of the hydraulic oil toward the arm cylinder 8 after decreasing the discharge rates of the main pumps 12L, 12R so that it can slow down a movement of the bucket 6 by slowing down a movement of the arm 5.

Also, the electromagnetic switching valve 19 may be arranged in a high pressure hydraulic line connecting a bottom-side chamber of the arm cylinder 8 and the flow control valve 155, or may be arranged in the two high pressure hydraulic lines. Also, the electromagnetic switching valve 19 may be arranged in a high pressure hydraulic line connecting the flow control valve 158 and the bucket cylinder 9. This is to slow down a movement of the bucket 6 selectively and directly.

Also, if the operating condition switching part 301 has restricted a flow of the hydraulic oil toward the arm cylinder 8 by putting the electromagnetic switching valve 19 into an active state, the operating condition switching part 301 restores an operating condition of the hydraulic shovel from a supply restricting state to a normal state by putting the electromagnetic switching valve 19 into an inactive state as needed.

Also, the activation of the electromagnetic switching valve 19 by the operating condition switching part 301 is performed or kept on as far as the discharge rates of the main pumps 12L, 12R at a supply restricting state is greater than a discharge rate (50 liters per minute) set by the negative control pressure regulation. In contrast, the activation of the electromagnetic switching valve 19 by the operating condition switching part 301 is cancelled or stopped when the discharge rates of the main pumps 12L, 12R at a supply restricting state has fallen below the discharge rate set by the negative control pressure regulation. This is because a slow movement of the bucket 6 is achieved by a discharge rate restricted by the negative control pressure regulation.

Figure 14:
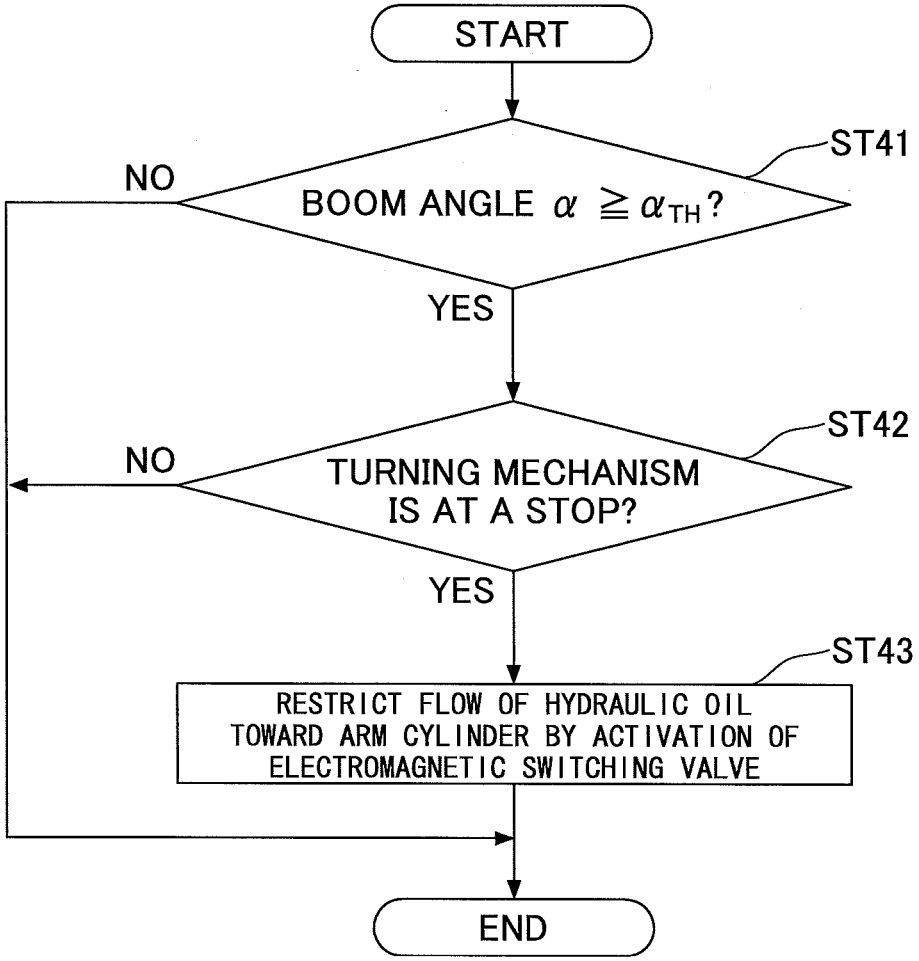
FIG. 14 is a third flowchart showing a flow of the operating condition switchover determining process.

FIG. 14 is a flowchart showing a flow of an operating condition switchover determining process in the hydraulic shovel according to the third embodiment.

FIG. 14 is characterized in that a procedure for restricting an amount of hydraulic oil toward the arm cylinder 8 in step ST43 is different from the procedure for decreasing the discharge rates of the main pumps 12L, 12R in step ST3 in FIG. 5 or in step ST23 in FIG. 9.

Specifically, the attachment condition determining part 300 determines whether the boom angle $\alpha$ is greater than or equal to the predetermined value $\alpha_{TH}$, based on the boom angle $\alpha$ detected by the boom angle sensor S1 (step ST41). In this way, the attachment condition determining part 300 can determine whether the attachment is within the upper working range UWR, and can determine whether the bucket 6 is within the upper working range UWR.

If the boom angle $\alpha$ is greater than or equal to the predetermined value $\alpha_{TH}$ (YES in step ST41), the operating condition switching part 301 determines whether the turning mechanism 2 is at a stop (step ST42).

If the operating condition switching part 301 determines that the turning mechanism 2 is at a stop, i.e., that the upper turning body 3 is not turning (YES in step ST42), the operating condition switching part 301 outputs a control signal to the electromagnetic switching valve 19 so that a flow of hydraulic oil toward the arm cylinder 8 is restricted (step ST43).

As a result, the operating condition switching part 301 can slow down a movement of the arm 5, and therefore can slow down a movement of the bucket 6.

According to the above configuration, the hydraulic shovel according to the third embodiment reduces an amount of hydraulic oil supplied to the arm cylinder 8 through an activation of the electromagnetic switching valve 19. Thus, the hydraulic shovel can selectively slow down a movement pace of the arm cylinder 8 in comparison to other hydraulic actuators, and therefore can selectively slow down a movement of the bucket 6 without affecting movements of the other hydraulic actuators.

Fourth Embodiment

Next, referring to FIGS. 15-17, there will be explained about a hydraulic shovel according to a fourth embodiment of the present invention.

The hydraulic shovel according to the fourth embodiment differs from the hydraulic shovels according to the first, second, and third embodiments in that the hydraulic shovel according to the fourth embodiment includes an arm angle sensor S2 at a coupled point where the arm 5 is coupled to the boom 4, and in that the attachment condition determining part 300 obtains detailed positional coordinates of the end attachment. Otherwise, both are common.

Thus, there will be explained about the differences in detail while omitting an explanation of the common points. Also, the same reference numbers as those used for explaining the hydraulic shovel according to the first embodiment are used.

Figure 15:
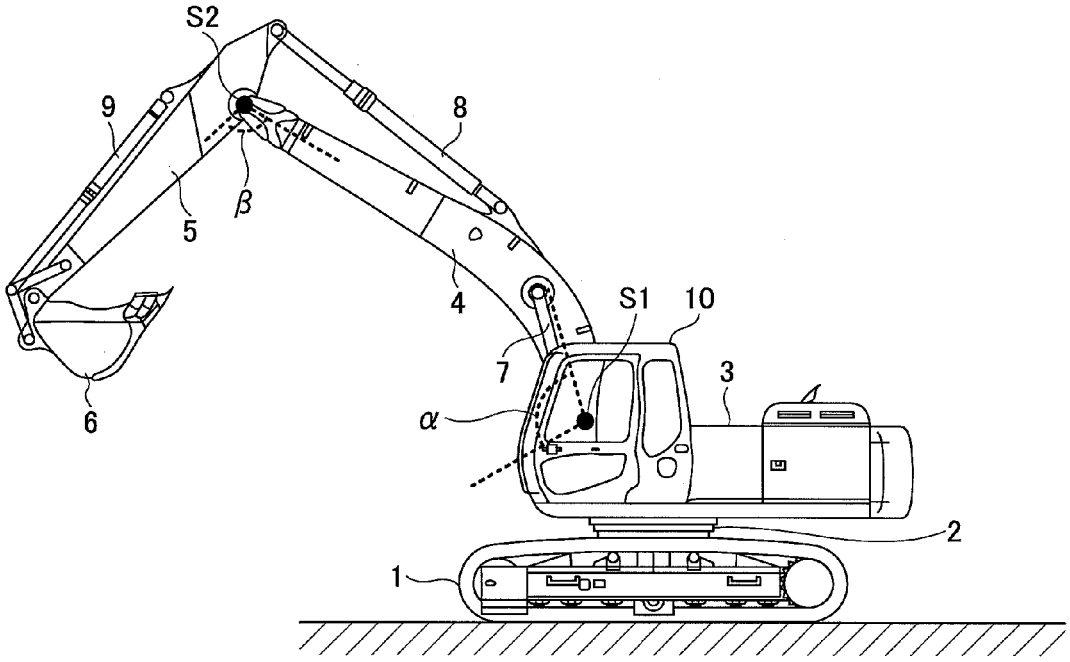
FIG. 15 is a second diagram showing a configuration example of a hydraulic shovel according to an embodiment of the present invention.
Figure 16:
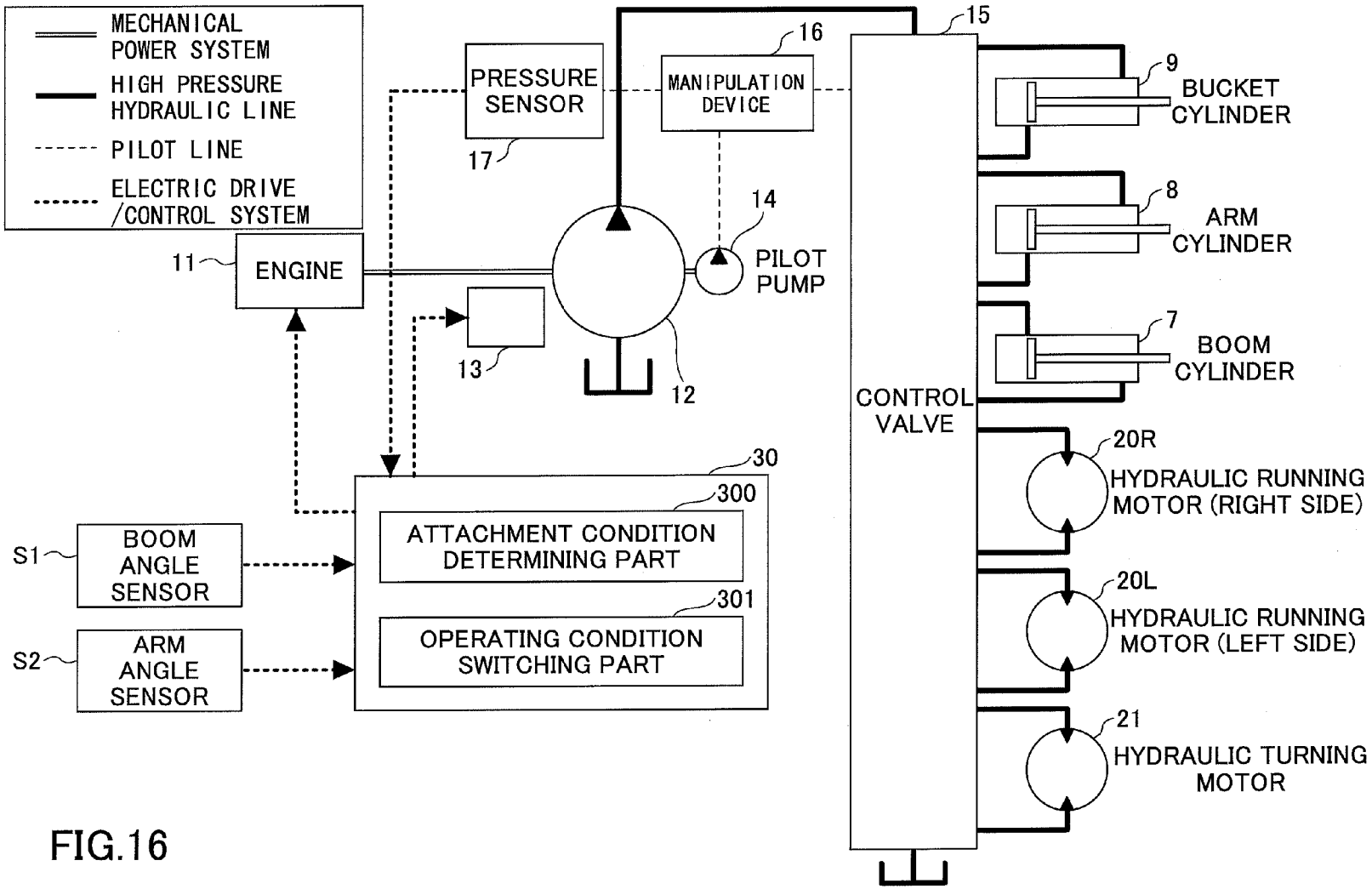
FIG. 16 is a second block diagram showing a configuration example of the drive system of the hydraulic shovel.

FIG. 15 is a side view showing the hydraulic shovel according to the fourth embodiment. FIG. 16 is a block diagram showing a configuration example of a drive system of the hydraulic shovel according to the fourth embodiment. In FIG. 16, as is the case in FIGS. 2 and 3, a mechanical power system, a high pressure hydraulic line, a pilot line, and an electric drive/control system are indicated by a double line, a solid line, a dashed line, and a dotted line, respectively.

The arm angle sensor S2 is a sensor configured to detect a pivot angle of the arm 5. For example, the arm angle sensor S2 detects an arm angle $\beta$, and outputs a detection value to the controller 30.

The controller 30 receives detection values of the boom angle sensor S1, the arm angle sensor S2, the pressure sensor 17, and the like, and performs a process by each of the attachment condition determining part 300 and the operating condition switching part 301 based on the detection values. Then, the controller 30 appropriately outputs a control signal corresponding to the processing result to the engine 11, the regulator 13, or the like.

The attachment condition determining part 300 obtains a positional coordinate of the end attachment in a two-dimensional coordinate system, for example, based on various predetermined values and various detection values. For example, the positional coordinate corresponds to a positional coordinate of a pivot center of the bucket 6, i.e., to a positional coordinate of a coupled point where the bucket 6 is coupled to the arm 5.

The various predetermined values include, for example, a distance between the pivot center of the boom 4 and the pivot center of the arm 5, a distance between the pivot center of the arm 5 and the pivot center of the bucket 6, and the like. Also, the various detection values include, for example, a detection value of the boom angle sensor S1, a detection value of the arm angle sensor S2, and the like.

Also, the two-dimensional coordinate system is, for example, a two-dimensional orthogonal coordinate system in which the origin is located at the pivot center of the boom 4 on a vertical plane including a middle line of the boom 4, where the X-axis is placed in a horizontal direction, and the Y-axis is placed in a vertical direction.

Also, the attachment condition determining part 300 may obtain a positional coordinate of the end attachment using other coordinate systems such as a two-dimensional polar coordinate system instead of the two-dimensional orthogonal coordinate system. Also the attachment condition determining part 300 may obtain a positional coordinate of the end attachment using a three-dimensional coordinate system.

Also, the attachment condition determining part 300 may obtain a positional coordinate of the end attachment based on an output of other detecting devices configured to detect a physical quantity relating to the end attachment, instead of the outputs of the boom angle sensor S1 and the arm angle sensor S2.

Also, the output of the detecting device includes an output of a sensor configured to detect stroke amounts of the boom cylinder 7 and the arm cylinder 8, an output of a receiver attached to the cabin 10 which receives an electric wave emitted by a transmitter attached to the bucket 6, or the like.

Figure 17:
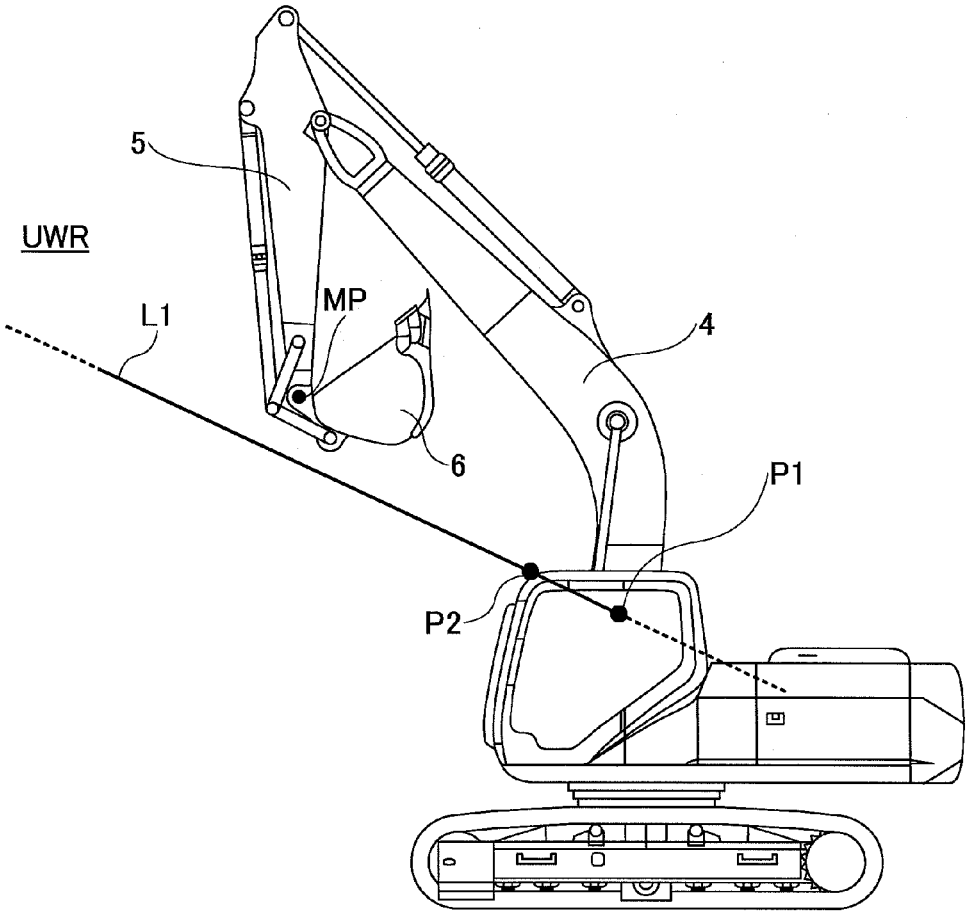
FIG. 17 is a second schematic diagram showing an example of an upper working range.

FIG. 17 is a schematic view showing an example of the upper working range UWR adopted by the hydraulic shovel according to the fourth embodiment. In FIG. 17, coordinate points P1, P2, MP, a straight line L1, and the middle line of the boom 4 are all on one and the same vertical plane.

The coordinate point P1 is a predetermined coordinate point corresponding to eye level of an operator when the operator sits on a seat in the cabin 10. The coordinate point P2 corresponds to a front edge of a roof (an upper edge of a windshield) of the cabin 10.

Also, the coordinate point MP corresponds to a coupled point where the bucket 6 is coupled to the arm 5 (the pivot center of the bucket 6).

The straight line L1 passes through the coordinate points P1 and P2. Also, the straight line L1 forms a boundary line separating the upper working range UWR from the other ranges.

In FIG. 17, the upper working range UWR, i.e., a range above the straight line L1 is represented as a range where the operator seated in the cabin 10 finds it difficult to see a condition of the bucket 6 due to the presence of a frame or a roof of the cabin 10 if the pivot center of the bucket 6 is within the upper working range UWR.

That is, the upper working range UWR represents a range where the operator does not feel stress even if a movement of the arm 5 or the bucket 6 slows down.

Also, the upper working range UWR may be set as a range above a horizontal line passing through the coordinate point P1 or P2.

According to the above configuration, the hydraulic shovel according to the fourth embodiment can achieve effects similar to the above effects achieved by the hydraulic shovel according to each of the first, second, and third embodiments.

Also, the hydraulic shovel according to the fourth embodiment can determine whether the bucket 6 is within the upper working range UWR more accurately, based on the detection values of the boom angle sensor S1 and the arm angle sensor S2.

Fifth Embodiment

Next, referring to FIGS. 18 and 19, there will be explained about a hybrid shovel according to a fifth embodiment of the present invention.

Figure 18:
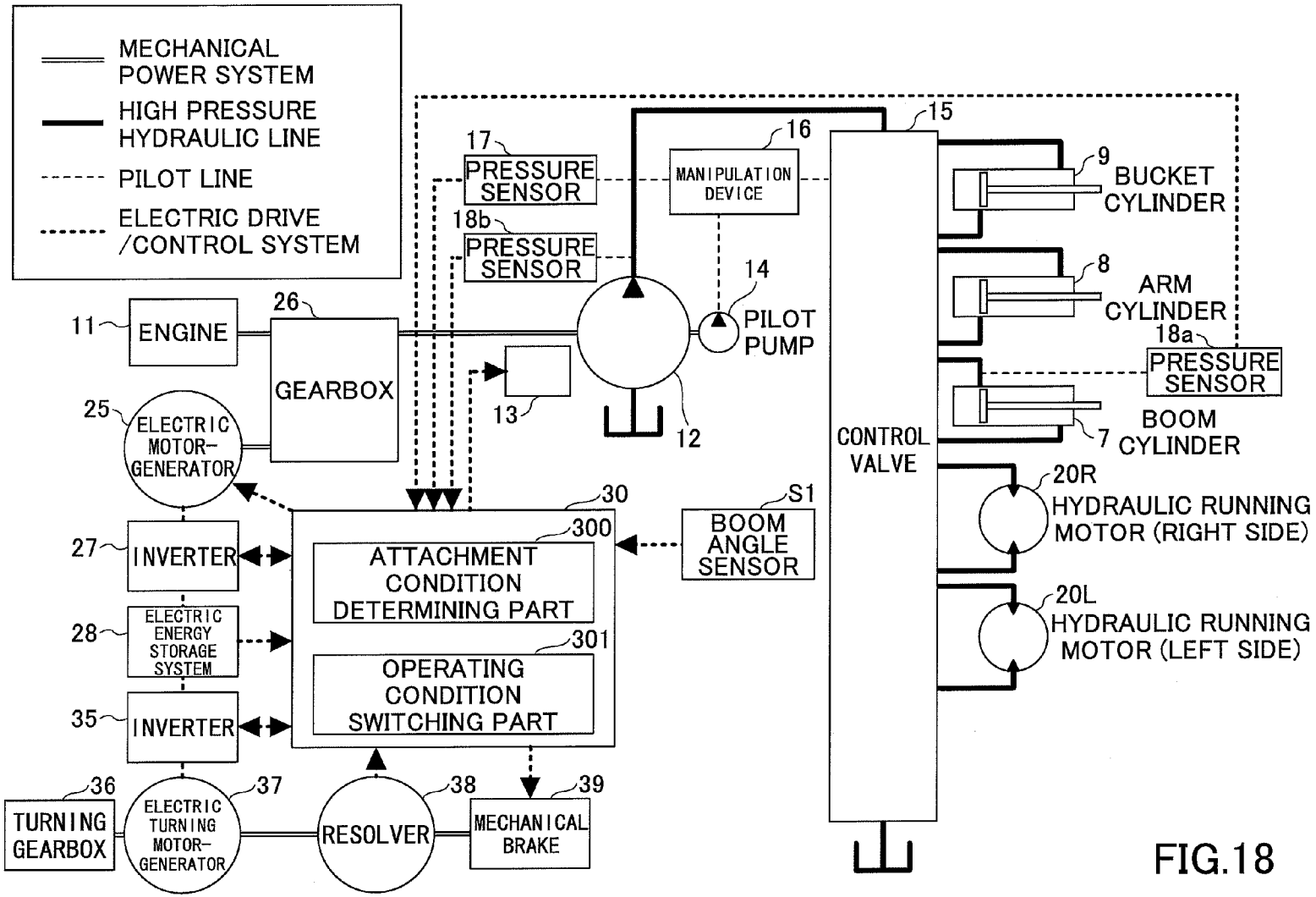
FIG. 18 is a block diagram showing a configuration example of a drive system of a hybrid shovel.
Figure 19:
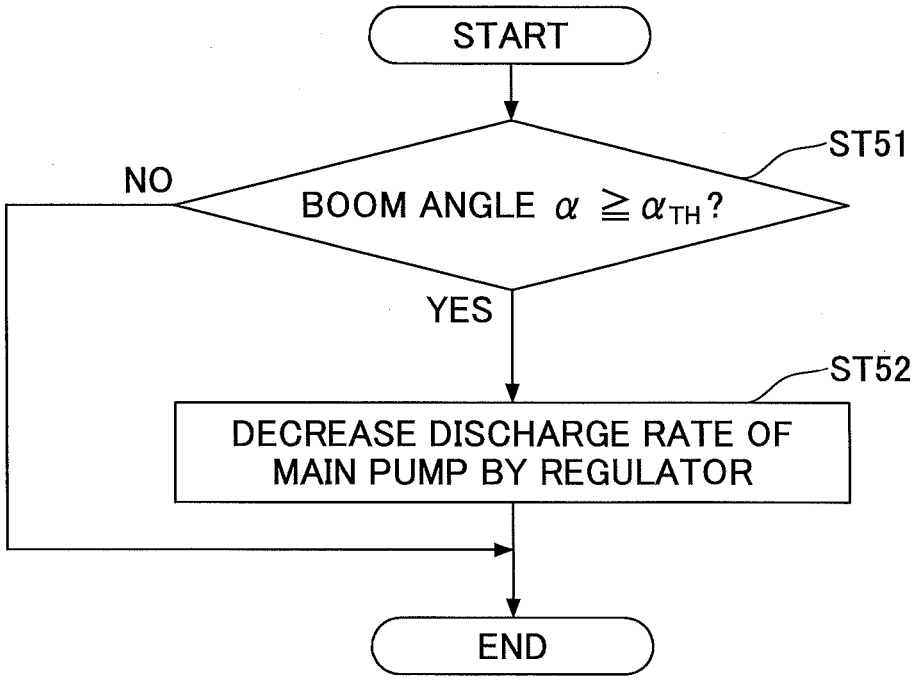
FIG. 19 is a fourth flowchart showing a flow of the operating condition switchover determining process.

FIG. 18 is a block diagram showing a configuration example of a drive system of the hybrid shovel.

The drive system of the hybrid shovel differs from the drive system (see FIG. 2) of the hydraulic shovel according to the first embodiment in that the drive system of the hybrid shovel mainly includes an electric motor-generator 25, a gearbox 26, an inverter 27, an electric energy storage system 28, and an electric turning mechanism. Otherwise, both are common. Thus, there will be explained about the differences in detail while omitting an explanation of the common points. Also, the same reference numbers as those used for explaining the hydraulic shovel according to the first embodiment are used.

The electric motor-generator 25 is a device configured to selectively perform an electricity generating operation where it is rotated by the engine 11 and generates electricity, or an assist operation where it is rotated by an electric power stored in the electric energy storage system 28 and assists an engine output.

The gearbox 26 is a transmission mechanism configured to include two input shafts and one output shaft. One of the two input shafts is coupled to the output shaft of the engine 11, the other of the two input shafts is coupled to a rotating shaft of the electric motor-generator 25, and the one output shaft is coupled to a rotating shaft of the main pump 12.

The inverter 27 is a device configured to perform a conversion between an alternating-current (AC) power and a direct-current (DC) power. The inverter 27 converts an AC power generated by the electric generator motor motor-generator 25 into an DC power, and stores the DC power in the electric energy storage system 28 (charging operation). Also, the inverter 27 converts a DC power stored in the electric energy storage system 28 into an AC power, and supplies the AC power to the electric motor-generator 25 (discharging operation). Also, the inverter 27 stops, switches, or starts the charging/discharging operation in response to a control signal from the controller 30, and outputs a piece of information about the charging/discharging operation to the controller 30.

The electric energy storage system 28 is a system configured to store a DC power. For example, the electric energy storage system 28 includes a capacitor, a step-down(buck)/step-up(boost) converter and a DC bus. The DC bus controls delivery and receipt of electric power between the capacitor and the electric motor-generator 25. The capacitor includes a capacitor voltage detecting part configured to detect a capacitor voltage value and a capacitor current detecting part configured to detect a capacitor current value. The capacitor voltage detecting part and the capacitor current detecting part output a capacitor voltage value and a capacitor current value to the controller 30, respectively. There has been explained about a capacitor as an example above. However, a chargeable/dischargeable secondary battery such as a lithium-ion battery or other forms of power source capable of delivering and receiving electric power may be used instead of the capacitor.

The electric turning mechanism mainly includes an inverter 35, a turning gearbox 36, an electric turning motor-generator 37, a resolver 38, and a mechanical brake 39.

The inverter 35 is a device configured to perform a conversion between an AC power and a DC power. The inverter 35 converts an AC power generated by the electric turning motor-generator 37 into an DC power, and stores the DC power in the electric energy storage system 28 (charging operation). Also, The inverter 35 converts a DC power stored in the electric energy storage system 28 into an AC power, and supplies the AC power to the electric turning motor-generator 37 (discharging operation). Also, the inverter 35 stops, switches, or starts the charging/discharging operation in response to a control signal from the controller 30, and outputs a piece of information about the charging/discharging operation to the controller 30.

The turning gearbox 36 is a transmission mechanism configured to include an input shaft and an output shaft. The input shaft is coupled to a rotating shaft of the electric turning motor-generator 37, and the output shaft is coupled to a rotating shaft of the turning mechanism 2.

The electric turning motor-generator 37 is a device configured to selectively perform a power running operation for turning the turning mechanism 2 by using electric power stored in the electric energy storage system 28, or a regenerative operation for converting kinetic energy of the turning mechanism 2 to electric energy.

The resolver 38 is a device configured to detect a turning speed of the turning mechanism 2 and output a detection value to the controller 30.

The mechanical brake 39 is a device configured to put a brake on the turning mechanism 2. The mechanical brake 39 mechanically prevents the turning mechanism 2 from turning in response to a control signal from the controller 30.

Next, referring to FIG. 19, there will be explained about a flow of an operating condition switchover determining process in the hybrid shovel according to the fifth embodiment.

The operating condition switchover determining process in the hybrid shovel differs from the operating condition switchover determining process in the hydraulic shovel in that the discharge rate of the main pump 12 is decreased independently of whether the turning mechanism 2 is at a stop. This is because the turning mechanism 2 is turned by the electric turning mechanism, and the turning mechanism 2 is not affected by a decrease in the discharge rate of the main pump 12.

Firstly, the attachment condition determining part 300 determines whether the boom angle $\alpha$ is greater than or equal to the predetermined value $\alpha_{TH}$ based on a value of the boom angle $\alpha$ detected by the boom angle sensor S1 (step ST51). In this way, the attachment condition determining part 300 can determine whether the attachment is within the upper working range UWR, and can also determine whether the bucket 6 is within the upper working range UWR, too.

If the attachment condition determining part 300 determines that the bucket 6 is not within the upper working range UWR, i.e., the boom angle $\alpha$ is lower than the predetermined value $\alpha_{TH}$ (NO in step ST51), the operating condition switching part 301 terminates this turn of the operating condition switchover determining process without switching an operating condition of the hybrid shovel from a normal state to a discharge rate decreased state.

In contrast, if the attachment condition determining part 300 determines that the bucket 6 is within the upper working range UWR, i.e., the boom angle $\alpha$ is greater than or equal to the predetermined value $\alpha_{TH}$ (YES in step ST51), the operating condition switching part 301 decreases a discharge rate of the main pump 12 so that movements of the hydraulic actuators slow down (step ST52). Specifically, the operating condition switching part 301 outputs a control signal to the regulator 13 and adjusts the regulator 13 so that a discharge rate of the main pump 12 may decrease. In this way, the operating condition switching part 301 can decrease a horsepower of the main pump 12 by decreasing a discharge rate of the main pump 12.

In this way, the operating condition switching part 301 can improve energy efficiency by curbing unnecessary energy consumption (e.g., unnecessary fuel consumption) caused by moving the arm 5 or the bucket 6 rapidly despite no need to move the arm 5 or the bucket 6 rapidly.

According to the above configuration, the hybrid shovel according to the fifth embodiment can achieve effects similar to the effects achieved by the hydraulic shovel according to the first embodiment.

Also, the hybrid shovel according to the fifth embodiment may decrease a horsepower of the main pump 12 by decreasing a rotational speed of the engine 11.

Also, the hybrid shovel according to the fifth embodiment may restrict an amount of hydraulic oil toward the arm cylinder 8 by activating the electromagnetic switching valve 19.

Sixth Embodiment

Figure 20:
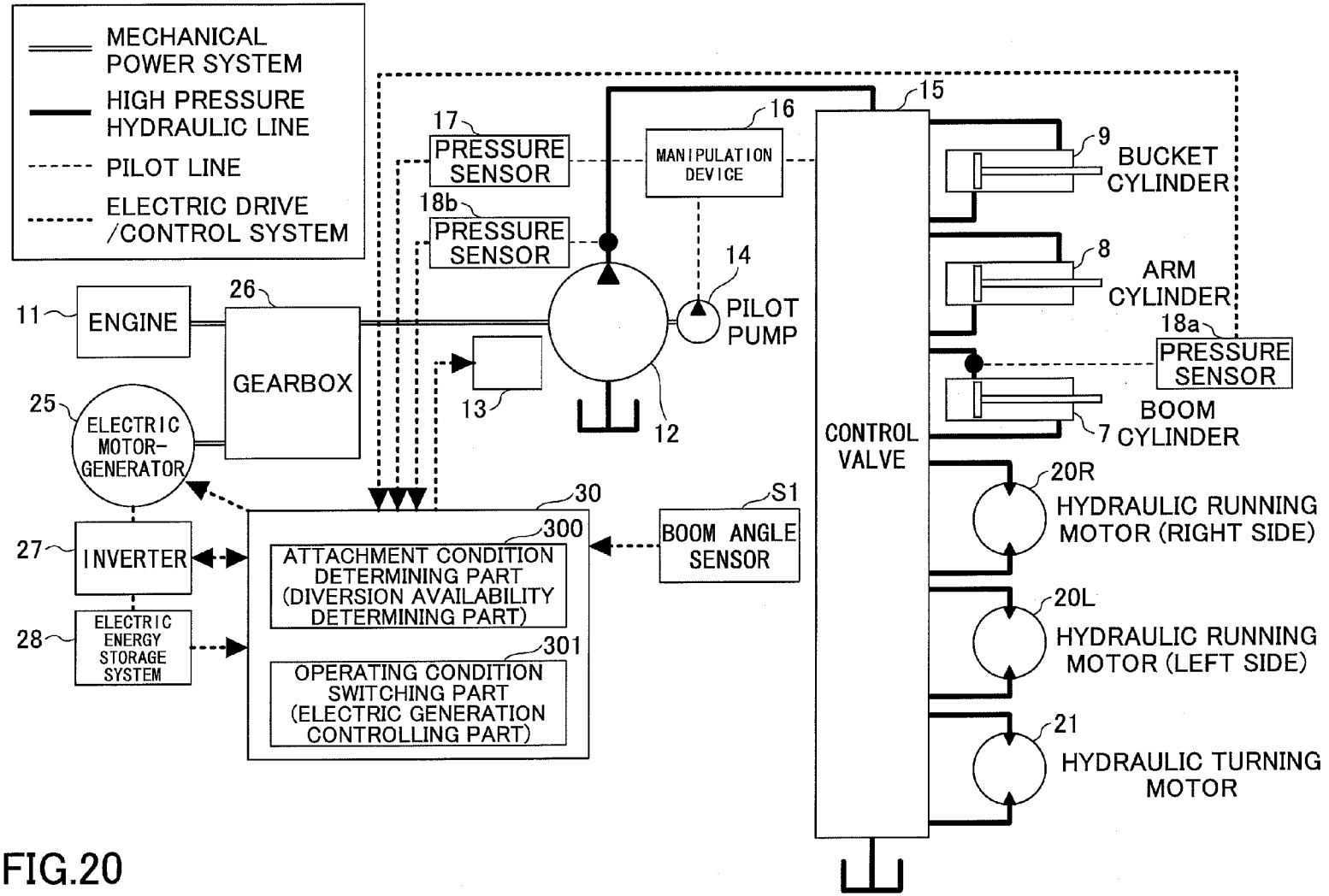
FIG. 20 is a third block diagram showing a configuration example of the drive system of the hydraulic shovel.

Next, referring to FIG. 20, there will be explained about a hydraulic shovel according to a sixth embodiment of the present invention. FIG. 20 is a block diagram showing a configuration example of a drive system of the hydraulic shovel. In FIG. 20, a mechanical power system, a high pressure hydraulic line, a pilot line, and an electric drive/control system are indicated by a double line, a solid line, a dashed line, and a dotted line, respectively.

Specifically, the controller 30 receives detection values from the boom angle sensor S1, the pressure sensor 17, the boom cylinder pressure sensor 18*a*, the discharge pressure sensor 18*b*, the inverter 27, the electric energy storage system 28, and the like. Then, based on the detection values, the controller 30 performs a process achieved by each of a diversion availability determining part 300 as the attachment condition determining part and an electric generation controlling part 301 as the operating condition switching part. Then, the controller 30 appropriately outputs a control signal to the regulator 13 and the inverter 27. The control signal corresponds to the processing result of each of the diversion availability determining part 300 and the electric generation controlling part 301.

More specifically, the diversion availability determining part 300 in the controller 30 determines whether it is possible to divert a part of an engine output being used for driving the main pump 12 to an operation of the electric motor-generator 25. Then, if the diversion availability determining part 300 determines that the diversion is possible, the electric generation controlling part 301 in the controller 30 adjusts the regulator 13 so as to decrease a discharge rate of the main pump 12 and gets the electric generation by the electric motor-generator 25 started. In what follows, a state where the discharge rate of the main pump 12 has been decreased and the electric generation has been started is referred to as a "discharge rate decreased/electricity-generating state", and a state before being switched to a discharge rate decreased/electricity-generating state is referred to as a "normal state".

Figure 21:
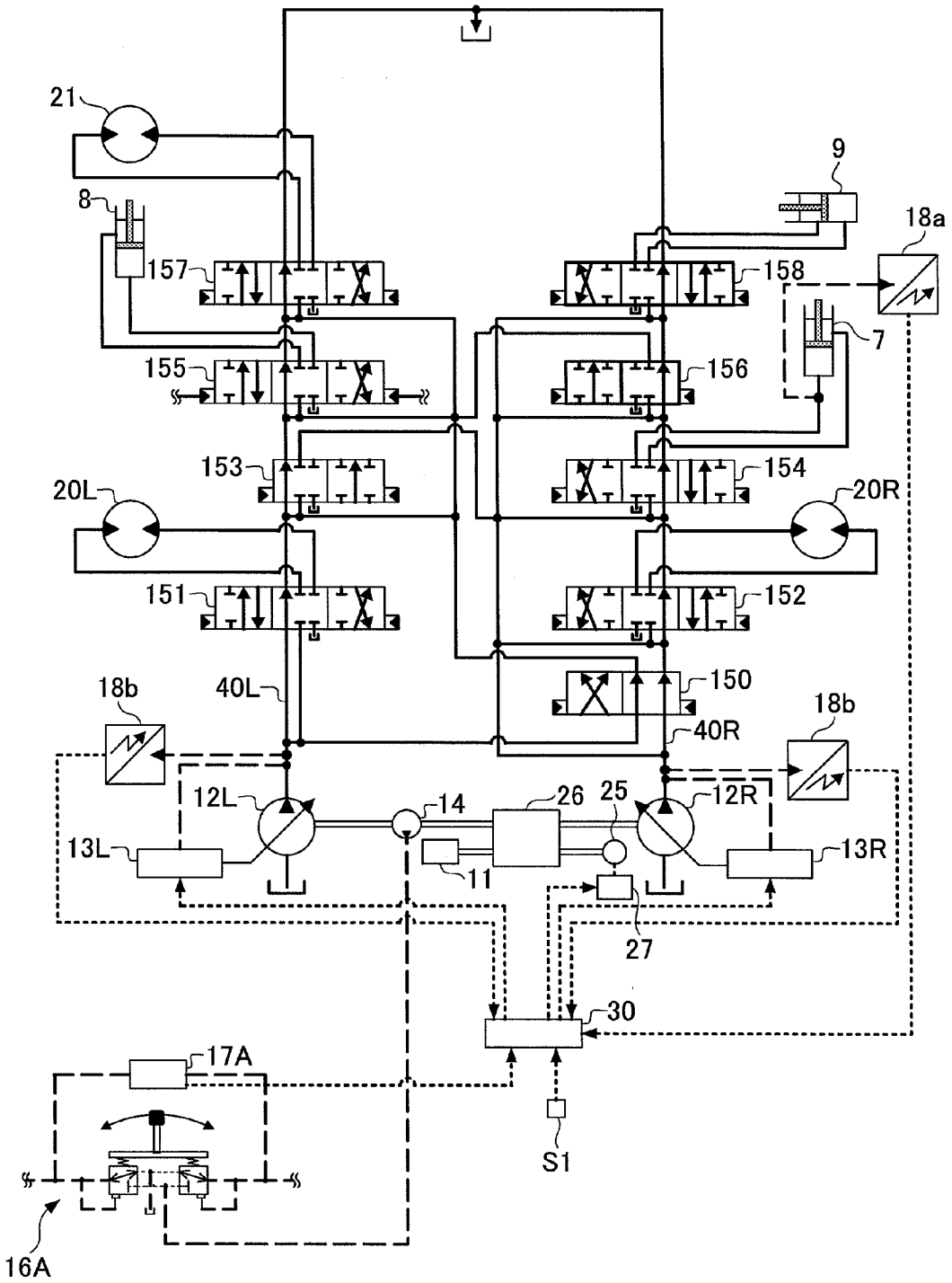
FIG. 21 is a third schematic diagram showing a configuration example of the hydraulic system installed in the hydraulic shovel.

Next, referring to FIG. 21, there will be explained about a mechanism configured to decrease a discharge rate of the main pump 12 and to get electric generation started. FIG. 21 is a schematic diagram showing a configuration example of the hydraulic system installed in the hydraulic shovel according to the sixth embodiment. In FIG. 21, as is the case in FIG. 20, a mechanical power system, a high pressure hydraulic line, a pilot line, and an electric drive/control system are indicated by a double line, a solid line, a dashed line, and a dotted line, respectively.

The controller 30 receives outputs from the boom angle sensor S1, the pressure sensor 17A, the boom cylinder pressure sensor 18*a*, the discharge pressure sensor 18*b*, and the like. Then, the controller 30 outputs a control signal to the regulators 13L, 13R and the inverter 27 as needed. This is to decrease discharge rates of the main pumps 12L, 12R, and to get electric generation by the electric motor-generator 25 started.

Next, referring to FIG. 22, there will be explained about details of the diversion availability determining part 300 and the electric generation controlling part 301 in the controller 30.

Figure 22:
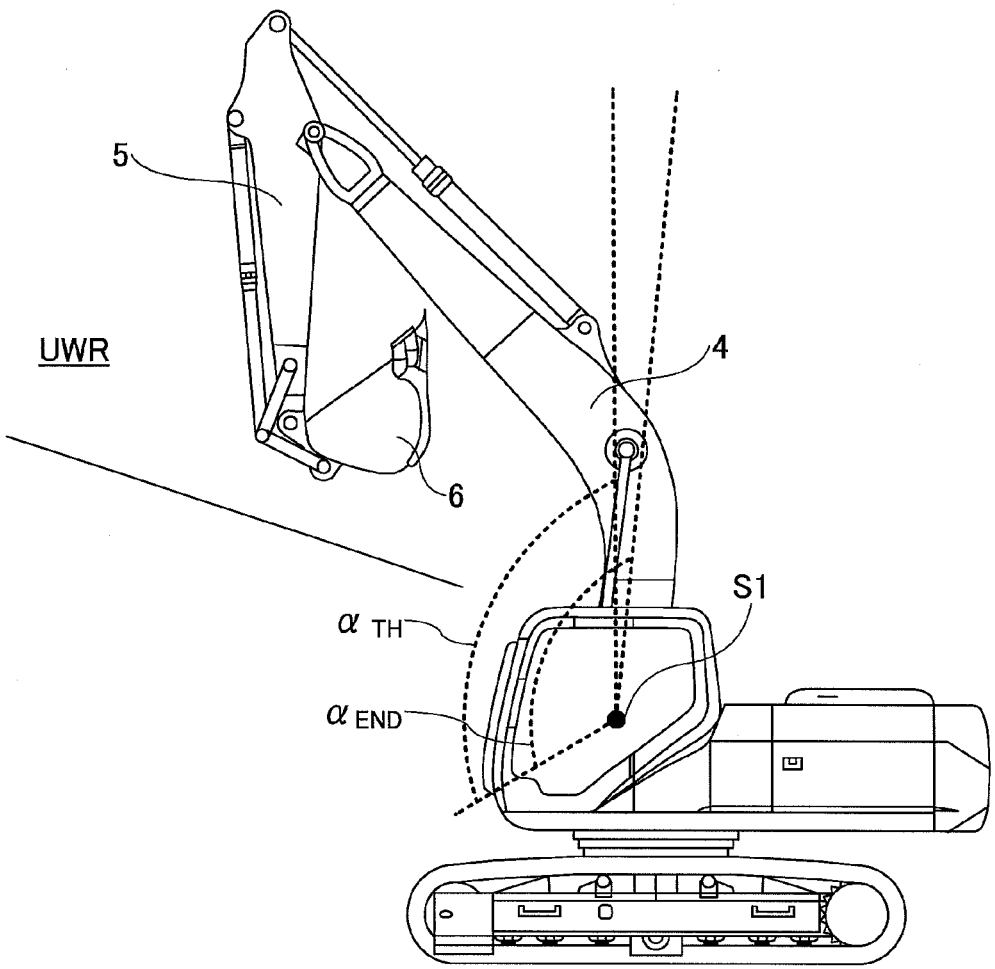
FIG. 22 is a diagram showing an example of a control-required state.

FIG. 22 is a schematic diagram showing an example of a state of the hydraulic shovel in a case that the diversion availability determining part 300 determines that it is possible to divert a part of an engine output for driving a main pump 12 to an operation of an electric motor-generator 25 (hereinafter referred to as a "control-required state"). Also, FIG. 22 corresponds to FIG. 4.

In the sixth embodiment, the control-required state is defined as, for example, a state of the hydraulic shovel when the end attachment is within the upper working range UWR.

The diversion availability determining part 300 determines whether it is possible to divert a part of the output of the engine 11 being used for driving the main pump 12 to an operation of the electric motor-generator 25.

Specifically, if the diversion availability determining part 300 determines that the boom angle $\alpha$ has become greater than or equal to a threshold value $\alpha_{TH}$ and that the bucket 6 has entered into the upper working range UWR, the diversion availability determining part 300 determines that it is possible to divert a part of the output of the engine 11 being used for driving the main pump 12 to an operation of the electric motor-generator 25. This is because an operator does not feel stress even if a movement of the less visible bucket 6 slowed down by a decrease in a horsepower of the main pump 12, i.e., by a decrease in a discharge rate of the main pump 12.

Also, the diversion availability determining part 300 may determine whether the bucket 6 has entered into the upper working range UWR by obtaining a rough position of the end attachment based on an output of a proximity sensor or the like configured to detect that the boom 4 has been lifted to a predetermined level, i.e., to detect a proximity of the boom 4.

The electric generation controlling part 301 controls electric generation by the electric motor-generator 25 using an output of the engine 11.

Specifically, if the diversion availability determining part 300 determines that it is possible to divert a part of the output of the engine 11 being used for driving the main pump 12 to an operation of the electric motor-generator 25, the electric generation controlling part 301 diverts a part of the output of the engine 11 being used for driving the main pump 12 to an operation of the electric motor-generator 25.

More specifically, the electric generation controlling part 301 outputs a control signal to the regulator 13L, 13R, and causes discharge rates of the main pumps 12L, 12R to decrease by adjusting the regulators 13L, 13R. This is to decrease a horsepower of the main pumps 12L, 12R.

Also, the electric generation controlling part 301 outputs a control signal to the inverter 27 and gets the electric generation by the electric motor-generator 25 started. This is to generate electricity by using a divertible engine output caused by a decrease in a horsepower of the main pumps 12L, 12R.

Figure 23:
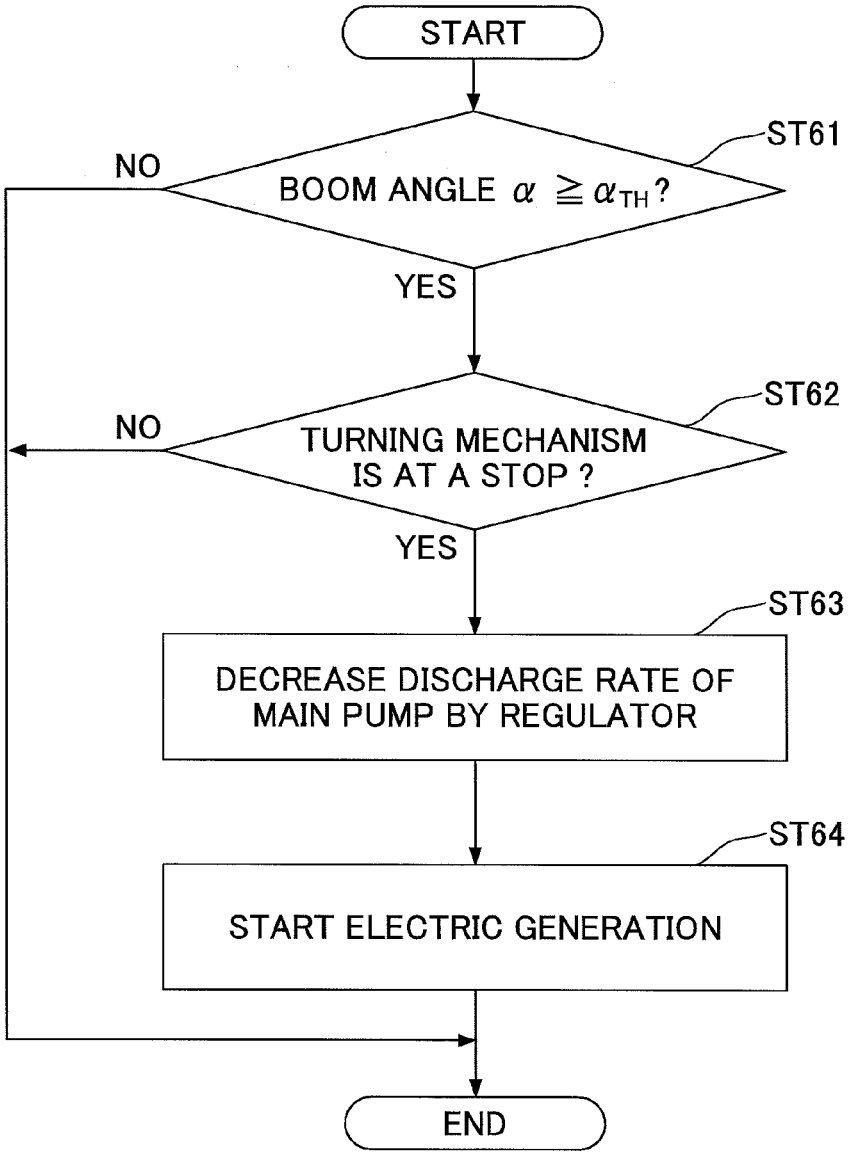
FIG. 23 is a first flowchart showing a flow of an electric generation start determining process.

Next, referring to FIG. 23, there will be explained about a process in which the controller 30 diverts a part of the output of the engine 11 being used for driving the main pumps 12L, 12R to an operation of the electric motor-generator 25 and gets the electric generation started (hereinafter referred to as an "electric generation start determining process"). FIG. 23 is a flowchart showing a flow of the electric generation start determining process. The controller 30 repeatedly performs this electric generation start determining process at predetermined intervals until the electric generation controlling part 301 gets the electric generation by the electric motor-generator 25 started.

Firstly, the diversion availability determining part 300 in the controller 30 determines whether the boom angle $\alpha$ is greater than or equal to the threshold value $\alpha_{TH}$ based on a value of the boom angle $\alpha$ detected by the boom angle sensor S1 (step ST61). In this way, the controller 30 can determine whether the attachment is within the upper working range UWR, and can also determine whether the bucket 6 is within the upper working range UWR, too.

If the controller 30 determines that the bucket 6 is not within the upper working range UWR, i.e., if the boom angle $\alpha$ is lower than the threshold value $\alpha_{TH}$ (NO in step ST61), the controller 30 terminates this turn of the electric generation start determining process without getting the electric generation by the electric motor-generator 25 started.

In contrast, if the controller 30 determines that the bucket 6 is within the upper working range UWR, i.e., if the boom angle $\alpha$ is greater than or equal to the threshold value $\alpha_{TH}$ (YES in step ST61), the controller 30 determines whether the turning mechanism 2 is at a stop (step ST62). Specifically, the controller 30 determines whether the turning mechanism 2 is at a stop by detecting an amount of lever manipulation of the turning body manipulating lever (not shown) based on a detection value of the pressure sensor 17.

If the controller 30 determines that the turning mechanism 2 is not at a stop, i.e., that the upper turning body 3 is turning (NO in step ST62), the controller 30 terminates this turn of the electric generation start determining process without getting the electric generation by the electric motor-generator 25 started.

In contrast, if the controller 30 determines that the turning mechanism 2 is at a stop, i.e., that the upper turning body 3 is not turning (YES in step ST62), the controller 30 decreases a discharge rate of the main pump 12 to decrease a horsepower of the main pump 12 (step ST63). Specifically, the electric generation controlling part 301 in the controller 30 outputs a control signal to the regulator 13 and decreases a discharge rate of the main pump 12 by adjusting the regulator 13.

Subsequently, the electric generation controlling part 301 in the controller 30 outputs a control signal to the inverter 27 and gets the electric generation by the electric motor-generator 25 started (step ST64). If the electricity generating operation has already been started, the controller 30 further increase an output of the electric generation by the electric motor-generator 25 in step ST64.

In this way, if the diversion availability determining part 300 determines that the diversion is possible, the controller 30 decreases a discharge rate of the main pump 12, makes it possible to divert a part of the output of the engine 11 having been used for driving the main pump 12 to an operation of the electric motor-generator 25, and gets the electric generation by the electric motor-generator 25 started.

Also, even if the diversion availability determining part 300 determines that the diversion is possible, if the controller 30 determines that the turning mechanism 2 is not at a stop, i.e., that the upper turning body is turning, the controller 30 terminates the electric generation start determining process without getting the electric generation started. This is to prevent an operator from having a feeling of strangeness due to the fact that a turning speed of the upper turning body 3 decreases as soon as the bucket 6 has entered into the upper working range UWR when the operator has lifted the boom 4 while turning the upper turning body 3. Similarly, the controller 30 may terminate the electric generation start determining process without getting the electric generation started if the controller 30 determines that the hydraulic running motor 20L, 20R or other end attachment attached instead of the bucket 6 (e.g., a breaker or the like) is at work. Specifically, even if the diversion availability determining part 300 determines that the diversion is possible, if the controller 30 determines that the hydraulic shovel is running, the controller 30 may terminate the electric generation start determining process without getting the electric generation started.

Figure 24:
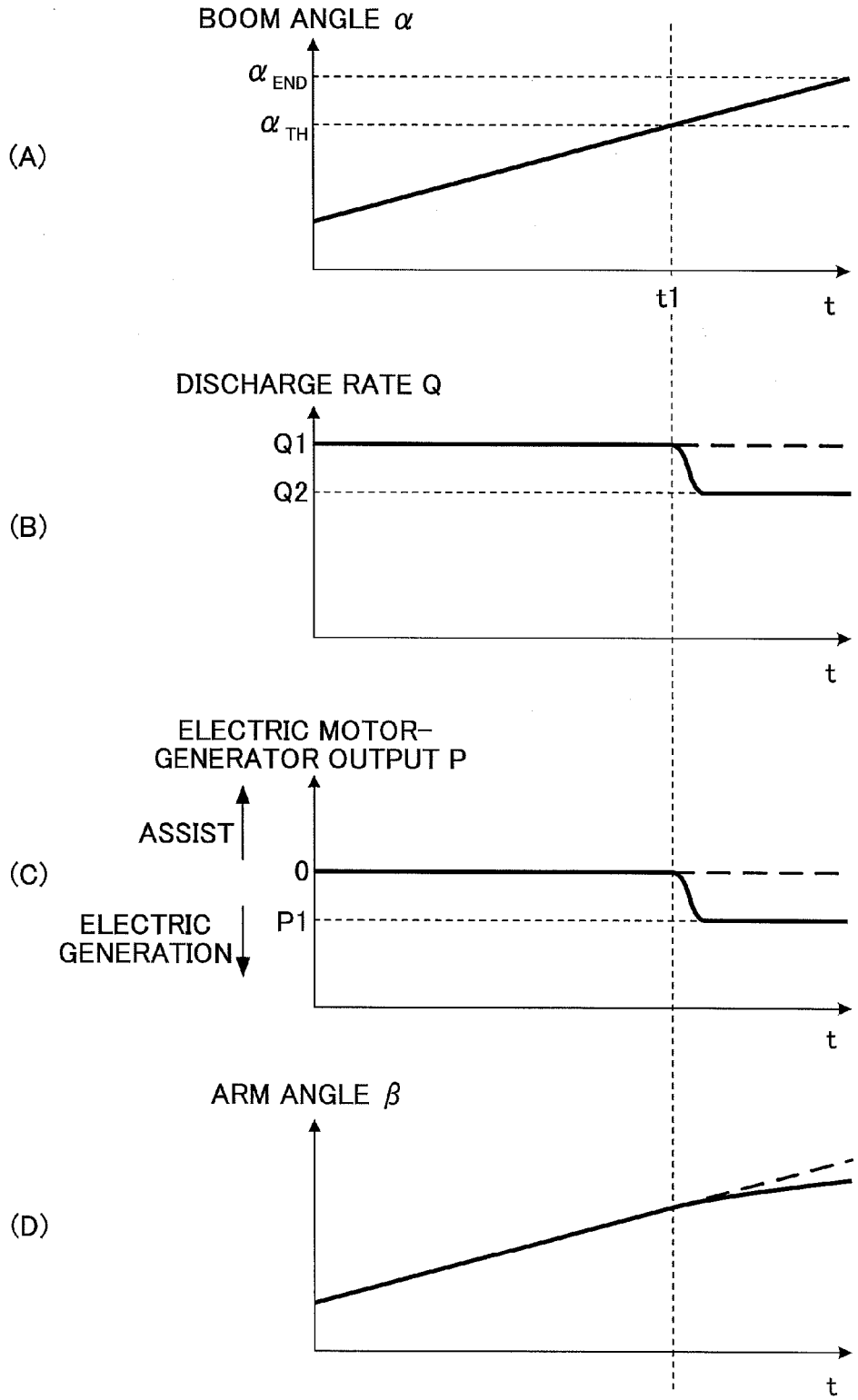
FIG. 24 is a diagram showing changes in various physical quantities in a case of diverting a part of an engine output being used for driving a main pump to an operation of an electric motor-generator.

FIG. 24 is a diagram showing temporal changes in a boom angle α, a discharge rate Q, an electric motor-generator output P, and an arm angle β (open angle from a most closed state of the arm 5) in a case where the controller 30 diverts a part of an engine output being used for driving the main pump 12 to an operation of the electric motor-generator 25. In FIG. 24, the operator of the hydraulic shovel performs a combined manipulation for lifting the boom 4 and opening the arm 5. An amount of lever manipulation of the boom manipulating lever (not shown) and that of the arm manipulating lever 16A are constant. Also, the discharge rate Q simultaneously indicates a discharge rate of each of the main pumps 12L, 12R. That is, discharge rates of the main pumps 12L, 12R follow the same trajectory.

A solid line in FIG. 24(A) indicates a change in the boom angle α which is common to a case where the discharge rate Q is controlled at a discharge rate decreased/electricity-generating state and a case where the discharge rate Q is not controlled at a discharge rate decreased/electricity-generating state.

A solid line in FIG. 24(B) indicates a change in the discharge rate Q of the main pump 12 in a case where the discharge rate Q is controlled at a discharge rate decreased/electricity-generating state, and a dashed line indicates a change in the discharge rate Q of the main pump 12 in a case where the discharge rate Q is not controlled at a discharge rate decreased/electricity-generating state. The discharge rate Q1 is a discharge rate at a normal state. In the sixth embodiment, the discharge rate Q1 is a maximum discharge rate. Also, the discharge rate Q2 is a discharge rate at a discharge rate decreased/electricity-generating state.

A solid line in FIG. 24(C) indicates a change in the electric motor-generator output P in a case where the discharge rate Q is controlled at a discharge rate decreased/electricity-generating state, and a dashed line indicates a change in the electric motor-generator output P in a case where the discharge rate Q is not controlled at a discharge rate decreased/electricity-generating state.

A solid line in FIG. 24(D) indicates a change in the arm angle β in a case where the discharge rate Q is controlled at a discharge rate decreased/electricity-generating state, and a dashed line indicates a change in the arm angle β in a case where the discharge rate Q is not controlled at a discharge rate decreased/electricity-generating state.

At a time point 0, the boom angle α is lower than the threshold value $\alpha_{TH}$, and the hydraulic shovel is at a state where the boom 4 has been lowered. Subsequently, at a time point t1, the boom angle α becomes greater than or equal to the threshold value $\alpha_{TH}$, and the diversion availability determining part 300 determines that the attachment has entered into the upper working range UWR. Thus, the diversion availability determining part 300 determines that the bucket 6 has entered into the upper working range UWR.

At this time, the discharge rate Q starts to decrease from the discharge rate Q1 at a normal state to the discharge rate Q2 at a discharge rate decreased/electricity-generating state. Thus, an increasing (opening) rate of the arm angle β decreases after the time point t1.

Also, the electric motor-generator output P starts to increase in an electric generation direction from a value of zero at a normal state to an electric generation output P1 at a discharge rate decreased/electricity-generating state. In the present embodiment, the electric generation direction corresponds to a minus direction, and an assist direction corresponds to a plus direction. The same goes for other embodiments.

This is because, at the time point t1, the diversion availability determining part 300 in the controller 30 has determined that it is possible to divert a part of the output of the engine 11 being used for driving the main pump 12 to an operation of the electric motor-generator 25, and the electric generation controlling part 301 in the controller 30 decreases a discharge rate of the main pump 12 and gets the electric generation by the electric motor-generator 25 started.

Specifically, this is because the diversion availability determining part 300 has determined that the boom angle α is greater than or equal to the threshold value $\alpha_{TH}$. Also, this is because the electric generation controlling part 301 has decreased a discharge rate of the main pump 12 by adjusting the regulator 13 through outputting a control signal to the regulator 13. Also, this is because the electric generation controlling part 301 has got the electric generation by the electric motor-generator 25 started through outputting a control signal to the inverter 27.

If the discharge rate Q is not controlled at a discharge rate decreased/electricity-generating state, at the time point t1, the discharge rate Q of the main pump 12 does not change but continue to be at the maximum discharge rate Q1. Thus, the arm angle β continues to increase at the same increasing rate as an increasing rate between the time point 0 and the time point t1. Also, the electric motor-generator output P remains unchanged and at a value of zero.

Also, changes indicated by the solid lines in FIG. 24(A)-(D) are applicable to a case of a combined manipulation for lifting the boom 4 and closing the arm 5. In that case, plus and minus of the arm angle β (see FIG. 24(D)) are reversed, and an increasing (opening) rate is read as a decreasing (closing) rate.

According to the above configuration, the hydraulic shovel according to the sixth embodiment decreases a discharge rate of the main pump 12 if the end attachment is within the upper working range UWR, i.e., if the boom angle α is greater than or equal to the threshold value $\alpha_{TH}$. Thus, the hydraulic shovel according to the sixth embodiment can restrict an engine output consumed by moving the arm 5 or the bucket 6 rapidly despite no need to move the arm 5 or the bucket 6 rapidly.

Also, the hydraulic shovel according to the sixth embodiment decreases a load of the engine 11 for driving the main pump 12 by decreasing a discharge rate of the main pump 12 so as to allow an output of engine 11 to be diverted to an operation of the electric motor-generator 25. On that basis, the hydraulic shovel gets the electric generation by the electric motor-generator 25 started. As a result, the hydraulic shovel according to the sixth embodiment can improve energy efficiency by generating electricity through using an engine output which has been wasted. In this way, the hydraulic shovel according to the sixth embodiment can improve energy efficiency by controlling a timing of the electric generation.

Also, even if the boom angle $\alpha$ is greater than or equal to the predetermined threshold value $\alpha_{TH}$, if the upper turning body is turning, the hydraulic shovel according to the sixth embodiment inhibits a switchover from a normal state to a discharge rate decreased/electricity-generating state. Thus, the hydraulic shovel can prevent an operator from having a feeling of strangeness due to the fact that a turning speed of the upper turning body 3 decreases as soon as the bucket 6 has entered into the upper working range UWR when the operator has lifted the boom 4 while turning the upper turning body 3.

Also, once the operating condition has been switched from a normal state to a discharge rate decreased/electricity-generating state, even if the arm 5 or the bucket 6 has been operated, the hydraulic shovel according to the sixth embodiment continues a discharge rate decreased/electricity-generating state. Thus, the hydraulic shovel can save an engine output for longer periods of time, generate electricity through using the saved engine output, and thus further improve the energy efficiency.

Also, the hydraulic shovel according to the sixth embodiment can estimate a rough position of the bucket 6 based on a determination of the attachment condition based on a climb angle of the boom 4, and then can determine whether the bucket 6 is within the upper working range UWR. As a result, the hydraulic shovel can achieve the above effects through using a simple device configuration.

In the sixth embodiment, an example using the boom angle sensor S1 as the boom operating condition detecting part has been explained. However, a boom cylinder pressure sensor 18*a* (see FIG. 20) may be used as the boom operating condition detecting part. When the boom 4 is lifted, a position of the center of gravity of the attachment changes, and a detection value of the boom cylinder pressure sensor 18*a* (see FIG. 20) changes, too. Thus, the hydraulic shovel can determine whether the boom 4 has been lifted beyond a predetermined angle by setting a threshold value for a pressure in the boom cylinder 7. Also, the hydraulic shovel can determine whether the attachment is within the upper working range UWR. In this way, the hydraulic shovel can obtain a rough position of the bucket 6, and can determine whether the bucket 6 is within the upper working range UWR.

Also, a discharge pressure of the main pump 12 increases with an increase in a pressure detected by the boom cylinder pressure sensor 18*a* (see FIG. 20). Thus, the hydraulic shovel may determine whether the boom 4 has been lifted beyond the predetermined angle by using the discharge pressure sensor 18*b* (see FIG. 20) as the boom operating condition detecting part.

Moreover, the hydraulic shovel may determine whether the boom 4 has been lifted beyond the predetermined angle by using a sensor configured to detect a stroke amount of the boom cylinder 7 as the boom operating condition detecting part.

Also, the hydraulic shovel according to the sixth embodiment decreases the discharge rate of the main pump 12 by adjusting the regulator 13. Thus, the hydraulic shovel can improve energy efficiency of the hydraulic shovel at a discharge rate decreased/electricity-generating state easily and reliably.

Seventh Embodiment

Figure 25:
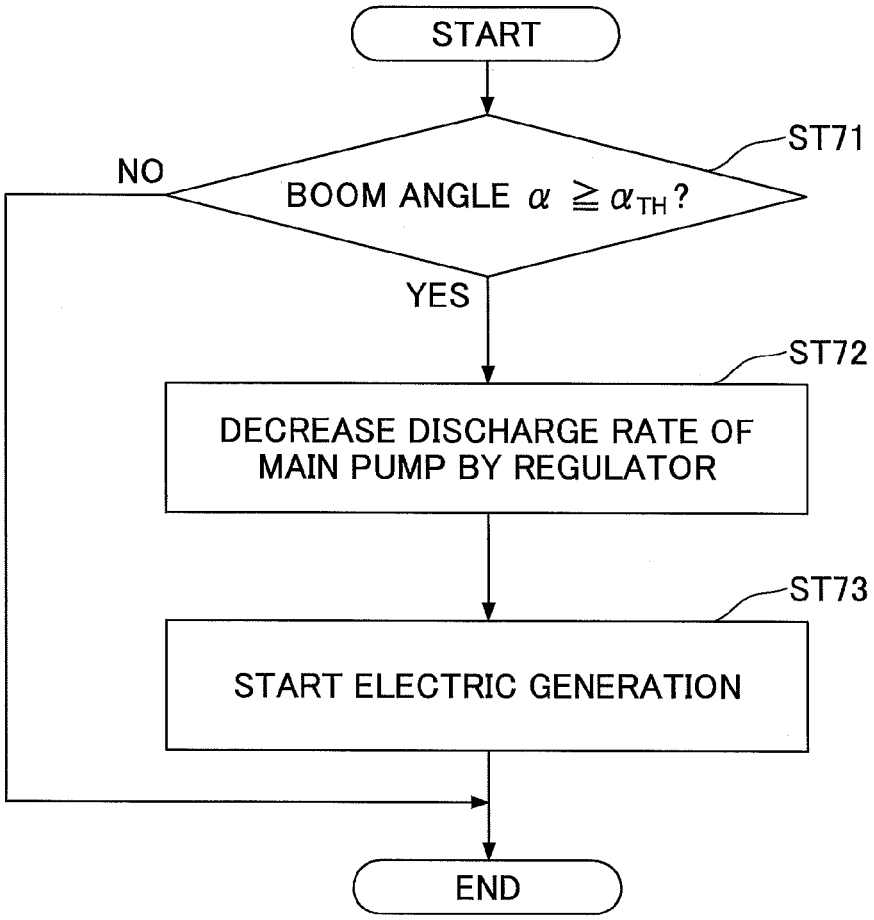
FIG. 25 is a second flowchart showing a flow of the electric generation start determining process.

Next, referring to FIG. 25, there will be explained about a flow of an electric generation start determining process in a hybrid shovel according to a seventh embodiment. A drive system of the hybrid shovel according to the seventh embodiment is identical to the drive system of the hybrid shovel according to the fifth embodiment shown in FIG. 18.

The electric generation start determining process in the hybrid shovel differs from the electric generation start determining process in the hydraulic shovel in that a discharge rate of the main pump 12 is decreased independently of whether the turning mechanism 2 is at a stop, and in that the electric generation by the electric motor-generator 25 is get started. This is because the turning mechanism 2 is turned by the electric turning mechanism, and the turning mechanism 2 is not affected by a decrease in the discharge rate of the main pump 12.

Firstly, the diversion availability determining part 300 in the controller 30 determines whether the boom angle $\alpha$ is greater than or equal to the predetermined value $\alpha_{TH}$ based on a value of the boom angle $\alpha$ detected by the boom angle sensor S1 (step ST71). In this way, the controller 30 can determine whether the attachment is within the upper working range UWR, and can also determine whether the bucket 6 is within the upper working range UWR, too.

If the diversion availability determining part 300 determines that the boom angle $\alpha$ is lower than the predetermined value $\alpha_{TH}$ (NO in step ST71), the electric generation controlling part 301 in the controller 30 terminates this turn of the electric generation start determining process without switching an operating condition of the hybrid shovel from a normal state to a discharge rate decreased/electricity-generating state.

In contrast, if the diversion availability determining part 300 determines that the boom angle $\alpha$ is greater than or equal to the predetermined value $\alpha_{TH}$ (YES in step ST71), the electric generation controlling part 301 in the controller 30 decreases a discharge rate of the main pump 12 (step ST72) and gets the electric generation by the electric motor-generator started (step ST73).

In this way, the controller 30 decreases a discharge rate of the main pump 12. Then, the controller 30 saves an engine output consumed by moving the arm 5 or the bucket 6 rapidly despite no need to move the arm 5 or the bucket 6 rapidly. As a result, the controller 30 makes it possible to divert the saved engine output to an operation of the electric generation.

According to the above configuration, the hybrid shovel according to the seventh embodiment can achieve effects similar to the effects achieved by the hydraulic shovel according to the sixth embodiment.

Also, in the sixth and seventh embodiments, there has been explained about a case where the electric generation controlling part 301 gets the electric generation by the electric motor-generator 25 started. However, if the electric generation controlling part 301 has already got the electricity generating operation started before the bucket 6 enters into the upper working range UWR, the electric generation controlling part 301 further increases an electric generation output by the electric motor-generator 25 after the bucket 6 has entered into the upper working range UWR. In this way, the electric generation controlling part 301 can perform the electricity generating operation by the electric motor-generator 25 efficiently by decreasing a horsepower of the main pump 12.

There has been explained preferable embodiments of the present invention in detail. However, the present invention is not intended to be limited to the above described embodiments. Various modifications, substitutions, or the like may be made to the above embodiments without deviating from the scope of the present invention.

For example, in the above embodiments, the operating condition switching part 301 may output a control signal to both the engine 11 and the regulators 13L, 13R as needed. This is to decrease discharge rates of the main pumps 12L, 12R and to slow down a movement of the bucket 6 by decreasing a rotational speed of the engine 11 and by adjusting the regulators 13L, 13R.

Also, in the above embodiments, the coordinate point MP is set to a coordinate point corresponding to a coupled point where the bucket 6 is coupled to the arm 5. However, the coordinate point MP may be set to a coordinate point corresponding to a point other than the coupled point (e.g., a coordinate point corresponding to a leading edge of the bucket 6).

Also, in the above embodiments, the operating condition switching part 301 adjusts a discharge rate of the main pump 12 in two steps, or adjusts an engine rotational speed of the engine 11 in two steps. However, the operating condition switching part 301 may adjust them in three or more steps.

Also, in the above embodiments, the electric generation controlling part 301 adjusts a discharge rate of the main pump 12 and an electric generation output by the electric motor-generator 25 in two steps, respectively. However, the electric generation controlling part 301 may adjust them in three or more steps.

Also, the present application is based on and claims the benefit of priority of each of Japanese Patent Application No. 2011-050790, filed on Mar. 8, 2011, Japanese Patent Application No. 2011-066732, filed on Mar. 24, 2011, and Japanese Patent Application No. 2011-096414, filed on Apr. 22, 2011, and the respective contents of these Japanese Patent Applications are incorporated herein by reference in their entirety.

DESCRIPTION OF REFERENCE NUMERALS

1 lower running body
2 turning mechanism
3 upper turning body
4 boom
5 arm
6 bucket
7 boom cylinder
8 arm cylinder
9 bucket cylinder
10 cabin
11 engine
12, 12L, 12R main pump
13, 13L, 13R regulator
14 pilot pump
15 control valve
16 manipulation device
16A arm manipulating lever
17, 17A pressure sensor
18*a* boom cylinder pressure sensor
18*b* discharge pressure sensor
19 electromagnetic switching valve
20L, 20R hydraulic running motor
21 hydraulic turning motor
25 electric motor-generator
26 gearbox
27 inverter
28 electric energy storage system
30 controller
35 inverter
36 turning gearbox
37 electric turning motor-generator
38 resolver
39 mechanical brake
40L, 40R center bypass hydraulic line
150-158 flow control valve
300 attachment condition determining part, diversion availability determining part
301 operating condition switching part, electric generation controlling part
S1 boom angle sensor
S2 arm angle sensor

The invention claimed is:

1. A shovel comprising:
a lower running body;
an upper turning body turnably mounted on the lower running body;
an engine mounted to the upper turning body;
a boom attached to the upper turning body;
a boom cylinder configured to drive the boom;
an arm attached to the boom;
an arm cylinder configured to drive the arm;
a bucket attached to the arm;
a bucket cylinder configured to drive the bucket;
a hydraulic pump connected to and driven by the engine and configured to supply a hydraulic oil to the boom cylinder, the arm cylinder and the bucket cylinder through a hydraulic line;
a cabin provided in the upper turning body, the cabin including a roof and a seat therein to allow an operator to sit thereon; and
a controller configured to decrease a speed of each of the boom, the arm and the bucket by reducing a horsepower of the hydraulic pump from a first horsepower to a second horsepower greater than zero so as to decrease an amount of the hydraulic oil supplied to the boom cylinder, the arm cylinder and the bucket cylinder upon determining that a position of the bucket is within a predetermined upper working range based on an output of a boom angle sensor while keeping the horsepower of the hydraulic pump at the first horsepower upon determining that the position of the bucket is out of the predetermined upper working range, the predetermined upper working range being an area above the cabin.

2. The shovel as claimed in claim 1, wherein the controller decreases the horsepower of the hydraulic pump by decreasing an engine rotational speed of the engine.

3. The shovel as claimed in claim 1, wherein the hydraulic pump is a variable displacement swash plate type hydraulic pump, and the controller decreases the horsepower of the hydraulic pump by adjusting a regulator.

4. The shovel as claimed in claim 1, wherein the arm is driven by hydraulic oil discharged from the hydraulic pump, the shovel further comprising:
a switching valve configured to be able to selectively restrict the amount of hydraulic oil supplied from the hydraulic pump to the arm, wherein the controller slows a movement of the bucket by restricting the amount of hydraulic oil supplied from the hydraulic pump to the arm through using the switching valve.

5. The shovel as claimed in claim 1, wherein the predetermined upper working range is set by using a pivot angle of the boom detected by the boom angle sensor.

6. The shovel as claimed in claim 1, wherein the controller determines that the bucket is within the upper working range in response to a detection that an angle of the boom is maximum or nearly maximum by the boom angle sensor, and decreases the horsepower of the hydraulic pump while keeping the arm operable over an entire range.

7. The shovel as claimed in claim 1, wherein the controller decreases the horsepower of a hydraulic pump upon determining that the bucket has entered into the upper working range independently of a distance to a cabin.

8. The shovel as claimed in claim 1, further comprising:

an electric motor-generator configured to drive the hydraulic pump, wherein the controller determines whether it is possible to divert a part of an output of the engine being used for driving the hydraulic pump to an operation of the electric motor-generator based on a condition of the boom, the arm and the bucket, and the controller diverts a part of an output of the engine being used for driving the hydraulic pump to an operation of the electric motor-generator.

9. The shovel as claimed in claim 8, wherein the controller gets an electric generation by the electric motor-generator started upon determining that it is possible to divert a part of an output of the engine being used for driving the hydraulic pump to an operation of the electric motor-generator while decreasing the horsepower of the hydraulic pump.

10. The shovel as claimed in claim 8, wherein the controller determines that it is possible to divert a part of an output of the engine being used for driving the hydraulic pump to an operation of the electric motor-generator upon detecting that a climb angle of the boom is greater than or equal to a threshold value by the boom angle sensor.

11. The shovel as claimed in claim 8, wherein the controller determines that it is possible to divert a part of an output of the engine being used for driving the hydraulic pump to an operation of the electric motor-generator upon determining that the bucket is within the predetermined upper working range.

12. A method for controlling a shovel including a lower running body, an upper turning body turnably mounted on the lower running body, an engine mounted to the upper turning body, a boom attached to the upper turning body, a boom cylinder configured to drive the boom, an arm attached to the boom, an arm cylinder configured to drive the arm, a bucket attached to the arm, a bucket cylinder configured to drive the bucket, a hydraulic pump connected to and driven by the engine and configured to supply a hydraulic oil to the boom cylinder, the arm cylinder and the bucket cylinder through a hydraulic line, and a cabin provided in the upper turning body, the cabin including a roof and a seat therein to allow an operator to sit thereon, the method comprising steps of:

detecting a position of the bucket based on an output of a boom angle sensor;

determining whether the position of the bucket is within a predetermined upper working range based on a detection value detected in the step of detecting the position of the bucket, the predetermined upper working range being an area above the cabin; and decreasing a speed of each of the boom, the arm and the bucket by reducing a horsepower of the hydraulic pump from a first horsepower to a second horsepower greater than zero so as to decrease an amount of the hydraulic oil supplied to the boom cylinder, the arm cylinder and the bucket cylinder upon determining that the position of the bucket is within the predetermined upper working range while keeping the horsepower of the hydraulic pump at the first horsepower upon determining that the position of the bucket is out of the predetermined upper working range.

13. The method for controlling as claimed in claim 12, wherein the horsepower of the hydraulic pump decreases with a decrease in an engine rotational speed in the step of decreasing the speed of each of the boom, the arm and the bucket.

14. The method for controlling as claimed in claim 12, wherein the hydraulic pump is a variable displacement swash plate type hydraulic pump, and the horsepower of the hydraulic pump decreases due to an adjustment of an regulator in the step of decreasing the speed of each of the boom, the arm and the bucket.

15. The method for controlling as claimed in claim 12, wherein the shovel further includes an electric motor-generator configured to drive the hydraulic pump, it is determined whether it is possible to divert a part of an output of the engine being used for driving the hydraulic pump to an operation of the electric motor-generator based on a condition of the bucket in the step of determining whether the position of the bucket is within the predetermined upper working range, and a part of an output of the engine being used for driving the hydraulic pump is diverted to an operation of the electric motor-generator in the step of decreasing the speed of each of the boom, the arm and the bucket.

16. The shovel as claimed in claim 9, wherein the controller determines that it is possible to divert a part of an output of the engine being used for driving the hydraulic pump to an operation of the electric motor-generator upon determining a climb angle of the boom detected by the boom angle sensor is greater than or equal to a threshold value.

17. The shovel as claimed in claim 9, wherein the controller determines that it is possible to divert a part of an output of the engine being used for driving the hydraulic pump to an operation of the electric motor-generator upon determining that the bucket is within the predetermined upper working range.

18. The shovel as claimed in claim 1, wherein the predetermined upper working range is a preset range determined depending on a shape of the cabin.

19. The shovel as claimed in claim 1, wherein the predetermined upper working range is set at an area above a straight line passing through a first predetermined coordinate point set in the cabin and a second predetermined coordinate point set at a front edge of the roof of the cabin.

* * * * *